US007197876B1

(12) United States Patent
Kalina

(10) Patent No.: US 7,197,876 B1
(45) Date of Patent: Apr. 3, 2007

(54) SYSTEM AND APPARATUS FOR POWER SYSTEM UTILIZING WIDE TEMPERATURE RANGE HEAT SOURCES

(75) Inventor: Alexander I. Kalina, Hillsborough, CA (US)

(73) Assignee: Kalex, LLC, Belmont, CA (US)

( * ) Notice: Subject to any disclaimer, the term of this patent is extended or adjusted under 35 U.S.C. 154(b) by 0 days.

(21) Appl. No.: 11/238,173

(22) Filed: Sep. 28, 2005

(51) Int. Cl.
*F01K 25/06* (2006.01)

(52) U.S. Cl. ..... 60/649; 60/651; 60/671

(58) Field of Classification Search ..... 60/649, 60/651, 653, 671, 673
See application file for complete search history.

(56) References Cited

U.S. PATENT DOCUMENTS

| | | | | |
|---|---|---|---|---|
| 5,095,708 | A * | 3/1992 | Kalina | 60/673 |
| 5,572,871 | A * | 11/1996 | Kalina | 60/649 |
| 6,058,695 | A * | 5/2000 | Ranasinghe et al. | 60/39.182 |
| 6,065,280 | A * | 5/2000 | Ranasinghe et al. | 60/774 |
| 6,735,948 | B1 | 5/2004 | Kalina | 60/649 |
| 6,769,256 | B1 | 8/2004 | Kalina | 60/653 |
| 6,820,421 | B2 | 11/2004 | Kalina | 60/649 |
| 6,829,895 | B2 | 12/2004 | Kalina | 60/649 |
| 6,910,334 | B2 | 6/2005 | Kalina | 60/651 |
| 6,923,000 | B2 | 8/2005 | Kalina | 60/649 |
| 6,941,757 | B2 | 9/2005 | Kalina | 60/649 |
| 6,968,690 | B2 * | 11/2005 | Kalina | 60/649 |
| 7,021,060 | B1 | 4/2006 | Kalina | 60/649 |
| 7,043,919 | B1 | 5/2006 | Kalina | 60/651 |
| 7,055,326 | B1 | 6/2006 | Kalina | 60/649 |
| 7,065,967 | B2 | 6/2006 | Kalina | 60/649 |
| 7,065,969 | B2 | 6/2006 | Kalina | 60/670 |
| 2005/0061654 | A1 | 3/2005 | Kalina | 203/21 |
| 2006/0096288 | A1 | 5/2006 | Kalina | 60/649 |
| 2006/0096290 | A1 | 5/2006 | Kalina | 60/649 |
| 2006/0165394 | A1 | 7/2006 | Kalina | 392/386 |
| 2006/0199120 | A1 | 9/2006 | Kalina | 431/9 |

OTHER PUBLICATIONS

U.S. Appl. No. 11/514,290, filed Aug. 31, 2006, Kalina.
U.S. Appl. No. 11/399,287, filed Apr. 5, 2006, Kalina.
U.S. Appl. No. 11/399,306, filed Apr. 5, 2006, Kalina.
U.S. Appl. No. 11/235,654, filed Sep.22, 2005, Kalina.
U.S. Appl. No. 11/227,991, filed Sep.15, 2005, Kalina.

* cited by examiner

*Primary Examiner*—Hoang Nguyen
(74) *Attorney, Agent, or Firm*—Robert W Strozier

(57) ABSTRACT

A new method, system and apparatus for power system utilizing wide temperature range heat sources and a multi-component working fluid is disclosed including a heat recovery vapor generator (HRVG) subsystem, a multi-stage energy conversion or turbine (T) subsystem and a condensation thermal compression subsystem (CTCSS) and where one or more of the streams exiting the stages of the turbine subsystem T are sent back through different portions of the HRVG to be warmed and/or cooled before being forwarded to the next stage of the turbine subsystem T. The turbine subsystem T includes at least a high pressure turbine or turbine stage (HPT) and a low pressure turbine or turbine stage (LPT) and preferably, an intermediate pressure turbine or turbine stage (IPT).

23 Claims, 12 Drawing Sheets

SYSTEM AND APPARATUS FOR POWER SYSTEM UTILIZING WIDE TEMPERATURE RANGE HEAT SOURCES

BACKGROUND OF THE INVENTION

1. Field of the Invention

The present invention relates to a bottoming cycle system for converting a portion of heat from a heat source stream, especially, an exhaust stream from an internal combustion engine, into usable mechanical and/or electrical power.

More particularly, the present invention relates to a bottoming cycle system for converting a portion of heat from a heat source stream, especially, an exhaust stream from an internal combustion engine, into usable mechanical and/or electrical power, where the system includes a heat recovery vapor generator (HRVG) subsystem, a multi-stage energy conversion or turbine (T) subsystem and a condensation thermal compression subsystem (CTCSS) and where one or more of the streams exiting the stages of the turbine subsystem T are sent back through different portions of the HRVG to be warmed and/or cooled before being forwarded to the next stage of the turbine subsystem T. The turbine subsystem T includes at least a high pressure turbine or turbine stage (HPT) and a low pressure turbine or turbine stage (LPT) and preferably, an intermediate pressure turbine or turbine stage (IPT).

2. Description of the Related Art

In U.S. Pat. Nos. 5,095,708 and 5,572,871, power systems were presented that were designed to serve as bottoming cycles for combined cycle systems. These systems both had a specific feature which was the key to their high efficiency; both systems used intercooling of the working fluid in between turbine stages. Because the heat released during intercooling was recuperated, it was then used as an additional source of heating for the process of vaporization. This resulted in a drastic increase in the thermodynamical reversibility and correspondingly in higher efficiency of the power cycle.

However, in the prior art, this process of intercooling was performed in a special heat exchanger, a so-called "intercooler." Such an intercooler requires that the streams of working fluid in both the tubes and the shell of the intercooler be at high pressure. Moreover, the intercooled stream in the prior art is in the form of a vapor, and therefore the heat transfer coefficient from the vapor to the intercooler tubes is low. As a result, such an intercooler must be a very large and very expensive high pressure heat exchanger. This in turn has a very negative impact on the economics of the entire system.

Thus, there is a need in the art for a system designed to utilize heat from heat sources having a wide range of temperatures and to convert a potion of energy from these heat sources into mechanical and/or electrical power.

SUMMARY OF THE INVENTION

The present invention provides a bottoming cycle system including a heat recovery vapor generator subsystem (HRVG), a multi-stage energy conversion or turbine subsystem (T) and a condensation thermal compression subsystem (CTCSS). The system is designed so that one or more of the streams exiting the stages of the turbine subsystem T are sent back through different portions of the HRVG to be warmed and/or cooled before being forwarded to the next stage of the turbine subsystem T. The turbine subsystem T includes at least a high pressure turbine or turbine stage (HPT) and a low pressure turbine or turbine stage (LPT) and preferably, an intermediate pressure turbine or turbine stage (IPT).

The present invention also provides a bottoming cycle system including a heat recovery vapor generator subsystem (HRVG), a multi-stage energy conversion or turbine subsystem (T) and a condensation thermal compression subsystem (CTCSS). The turbine subsystem T includes a high pressure turbine or turbine stage (HPT), an intermediate pressure turbine or turbine stage (IPT) and a low pressure turbine or turbine stage (LPT). The HRVG includes five sections. The lower middle two sections comprise an intercooler and the top section comprises a reheater. The CTCSS can be a simple condenser or a more complex condensation thermal compression subsystem designed to more efficiently condense a multi-component working fluid. The system is designed so that a spent stream exiting the HPT of the turbine subsystem T is sent back through a top section of the HRVG to be reheated and a spent stream of the IPT is sent through the intercooler to provide additional heat for vaporing the working fluid stream.

The present invention also provides a bottoming cycle system including a heat recovery vapor generator subsystem (HRVG), a multi-stage energy conversion or turbine subsystem (T) and a condensation thermal compression subsystem (CTCSS). The turbine subsystem T includes a high pressure turbine or turbine stage (HPT) and a low pressure turbine or turbine stage (LPT). The HRVG includes five sections. The lower middle two sections comprise an intercooler. The CTCSS can be a simple condenser or a more complex condensation thermal compression subsystem designed to more efficiently condense a multi-component working fluid. The system is designed so that a spent stream exiting the HPT of the turbine subsystem T is through the intercooler to provide additional heat for vaporing the working fluid stream.

The present invention also provides a method including the step of pumping a fully condensed working fluid stream to a desired high pressure. The high pressure stream is then fed into a first or preheater section HR1 of a heat recovery vapor generator subsystem HRVG where it is preheated by a cool heat source stream. The preheated, high pressure stream is then forwarded successively through a second section HR2 and a third section HR3 of the HRVG, which comprise an intercooler, where the preheated, high pressure stream is vaporized by a cooled heat source stream and a spent intermediate pressure turbine or turbine stage (IPT) stream to form a vaporized working fluid stream. The vaporized working fluid stream is then superheated in a fourth section HR4 and a fifth section HR5 of the HRVG to form a superheated working fluid stream by a hot heat source stream. Simultaneously, a spent high pressure turbine or turbine state (HPT) stream is reheated by the superheated working fluid stream and the hot heat source stream. The superheated working fluid stream is then sent through an admission valve and into the high pressure turbine HPT, where a portion of its thermal energy is converted to mechanical and/or electrical power. The spent HPT stream, which has been reheated, is then sent into the intermediate pressure turbine or turbine stage IPT, where a portion of its thermal energy is converted to mechanical and/or electrical power. The spent IPT stream after passing through the intercooler where it is cooled is sent through a low pressure turbine or turbine stage LPT, where a portion of its thermal energy is converted to mechanical and/or electrical power.

The spent LPT stream is then forwarded to a condensation thermal compression subsystem (CTCSS), where it is fully condensed.

The present invention also provides a method including the step of pumping a fully condensed working fluid stream to a desired high pressure. The high pressure stream is then fed into a first or preheater section HR1 of a heat recovery vapor generator subsystem HRVG where it is preheated by a cool heat source stream. The preheated, high pressure stream is then forwarded successively through a second section HR2 and a third section HR3 of the HRVG, which comprise an intercooler, where the preheated, high pressure stream is vaporized by a cooled heat source stream and a spent high pressure turbine or turbine stage (HPT) stream to form a vaporized working fluid stream. The vaporized working fluid stream is then superheated in a fourth section HR4 and a fifth section HR5 of the HRVG to form a superheated working fluid stream by a hot heat source stream. The superheated working fluid stream is then sent through an admission valve and into the high pressure turbine HPT, where a portion of its thermal energy is converted to mechanical and/or electrical power. The spent HPT stream after passing through the intercooler where it is cooled is sent through a low pressure turbine or turbine stage LPT, where a portion of its thermal energy is converted to mechanical and/or electrical power. The spent LPT stream is then forwarded to a condensation thermal compression subsystem (CTCSS), where it is fully condensed.

A bottoming cycle system including a heat recovery vapor generator subsystem HRVG including: (1) a preheater section for preheating a fully condensed, high pressure working fluid stream with heat derived from a cool heat source stream to form a preheated, high pressure working fluid stream and a spent heat source stream; (2) an intercooler section for vaporizing the preheated, high pressure working fluid stream with heat derived from a cooled heat source stream and a low pressure working fluid stream to form a vaporized, high pressure working fluid stream, a cooled low pressure working fluid stream and the cool heat source stream; (3) a superheater section for superheating the vaporized, high pressure working fluid stream with heat derived from a hot heat source stream to form a superheated, high pressure working fluid stream and the cooled heat source stream. The system also includes a multi-stage energy conversion or turbine subsystem T including: (1) a high pressure turbine or turbine stage HPT for converting a portion of thermal energy in the superheated working fluid stream into a first portion of mechanical and/or electrical power to form the low pressure, working fluid stream; and (2) a low pressure turbine or turbine stage LPT for converting a portion of thermal energy in the cooled low pressure working fluid stream into a second portion of mechanical and/or electrical power to form a spent working fluid stream. The system further includes a condensation thermal compression subsystem CTCSS for condensing the spent working fluid stream to from the fully condensed, high pressure working fluid stream.

A bottoming cycle system including a heat recovery vapor generator subsystem HRVG including: wherein the HRVG further includes: (1) a preheater section for preheating a fully condensed, high pressure working fluid stream with heat derived from a cool heat source stream to form a preheated, high pressure working fluid stream and a spent heat source stream; (2) an intercooler section for vaporizing the preheated, high pressure working fluid stream with heat derived from a cooled heat source stream and a low pressure working fluid stream to form a vaporized, high pressure working fluid stream, a cooled low pressure working fluid stream and the cool heat source stream; (3) a superheater section for superheating the vaporized, high pressure working fluid stream with heat derived from a hot heat source stream to form a superheated, high pressure working fluid stream and the cooled heat source stream; and (4) a reheater or top section for reheating an intermediate pressure, working fluid stream from the HPT with heat derived from the hot heat source stream to from a heated, intermediate pressure stream. The system also includes a multi-stage energy conversion or turbine subsystem T including: (1) a high pressure turbine or turbine stage HPT for converting a portion of thermal energy in the superheated working fluid stream into a first portion of mechanical and/or electrical power to form the low pressure, working fluid stream; (2) an intermediate pressure turbine or turbine stage IPT interposed between the HPT and the LPT for converting a portion of thermal energy in the heated intermediate pressure, working fluid stream into a third portion of mechanical and/or electrical power to form the low pressure, working fluid stream; and (3) a low pressure turbine or turbine stage LPT for converting a portion of thermal energy in the cooled low pressure working fluid stream into a second portion of mechanical and/or electrical power to form a spent working fluid stream. The system further includes a condensation thermal compression subsystem CTCSS for condensing the spent working fluid stream to from the fully condensed, high pressure working fluid stream.

A method including the steps of bringing a fully condensed, high pressure working fluid stream into a first heat exchange relationship with a cool heat source stream in a preheater of a heat recovery vapor generator subsystem HRVG to form a spent heat source stream and a preheated, high pressure working fluid stream. The preheated, high pressure working fluid stream is then brought into a second heat exchange relationship with a cooled heat source stream and a low pressure working fluid stream in an intercooler of the HRVG to form a vaporized, high pressure working fluid stream, the cool heat source stream, and a cooled low pressure working fluid stream. The vaporized, high pressure working fluid stream is then brought into a third heat exchange relationship with a hot heat source stream in a superheater of the HRVG to form a superheated, high pressure working fluid stream and the cooled heat source stream. A portion of thermal energy in the superheated, high pressure working fluid stream is then converted into a first portion of mechanical and/or electrical power in a high pressure turbine or turbine stage HPT of a turbine subsystem T to form the low pressure working fluid stream. A portion of thermal energy in the cooled low pressure working fluid stream is then converted into a second portion of mechanical and/or electrical power in a low pressure turbine or turbine stage LPT of a turbine subsystem T to form a spent working fluid stream. Finally, the spent working fluid stream is fully condensed in a condensation thermal compression subsystem CTCSS to form the fully condensed, high pressure working fluid stream.

A method including the steps of bringing a fully condensed, high pressure working fluid stream into a first heat exchange relationship with a cool heat source stream in a preheater of a heat recovery vapor generator subsystem HRVG to form a spent heat source stream and a preheated, high pressure working fluid stream. The preheated, high pressure working fluid stream is then brought into a second heat exchange relationship with a cooled heat source stream and a low pressure working fluid stream in an intercooler of the HRVG to form a vaporized, high pressure working fluid stream, the cool heat source stream, and a cooled low pressure working fluid stream. The vaporized, high pressure working fluid stream is then brought into a third heat exchange relationship with a hot heat source stream in a superheater of the HRVG to form a superheated, high pressure working fluid stream and the cooled heat source stream. A portion of thermal energy in the superheated, high pressure working fluid stream is then converted into a first portion of mechanical and/or electrical power in a high pressure turbine or turbine stage HPT of a turbine subsystem T to form the low pressure working fluid stream. An intermediate pressure working fluid stream from the HPT is then reheated in a reheater or top section of the HRVG to form a heated, intermediate pressure working fluid stream. A portion of thermal energy in the heated intermediate pressure working fluid stream is then converted into a third portion of mechanical and/or electrical power in an intermediate pressure turbine or turbine stage IPT of a turbine subsystem T to form the low pressure working fluid stream. A portion of thermal energy in the cooled low pressure working fluid stream is then converted into a second portion of mechanical and/or electrical power in a low pressure turbine or turbine stage LPT of a turbine subsystem T to form a spent working fluid stream. Finally, the spent working fluid stream is fully condensed in a condensation thermal compression subsystem CTCSS to form the fully condensed, high pressure working fluid stream.

BRIEF DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
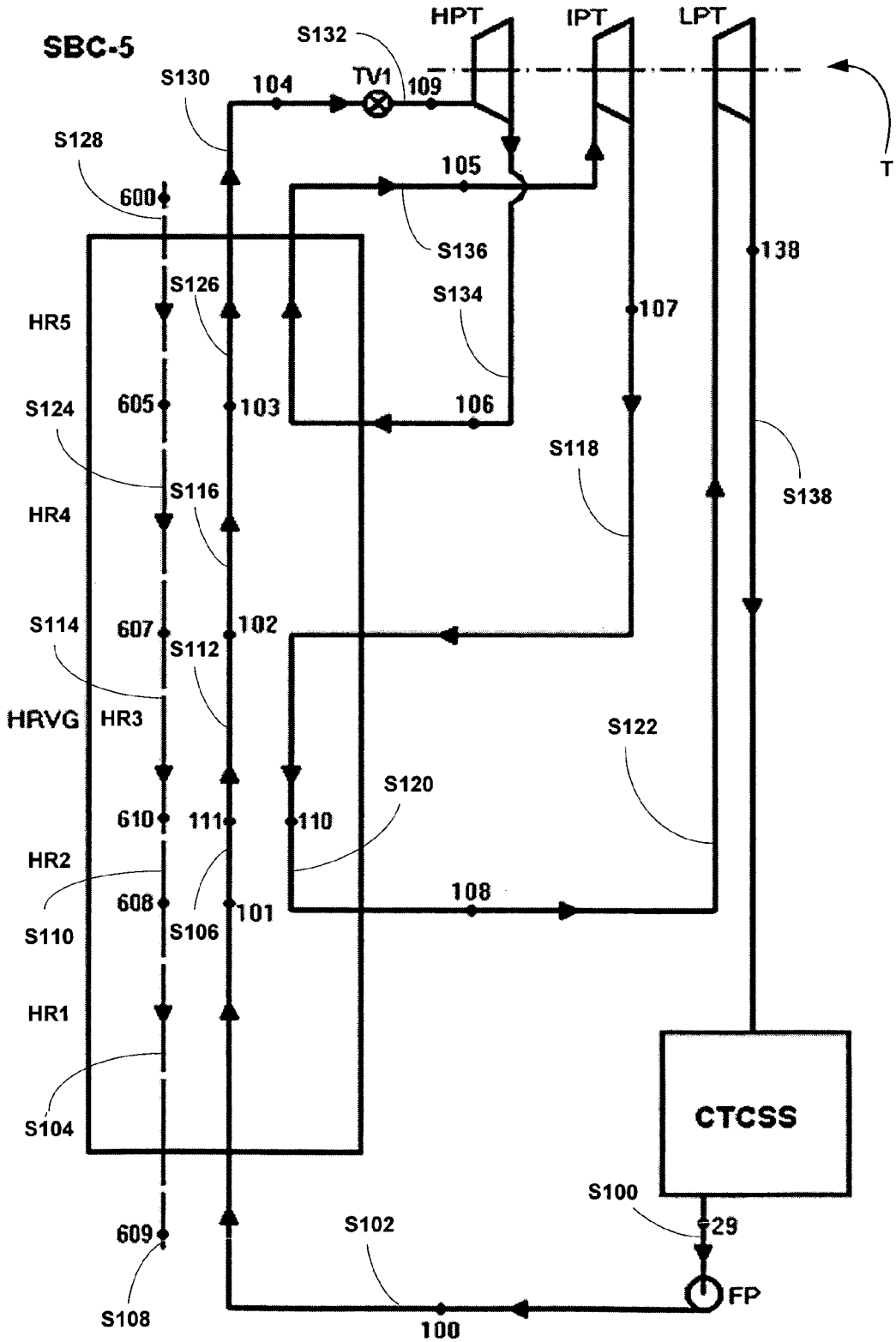
FIG. 1 depicts a block diagram of a preferred embodiment a power system of this invention.

The inventors have found a new bottoming system can be constructed using a heat recovery vapor generator (HRVG) subsystem, a multi-stage energy conversion subsystem and a condensation thermal compression subsystem (CTCSS), where one or more of the streams exiting the stages are set back through different portions of the HRVG to be warmed before being forwarded to the next stage. The multi-stage energy conversion or turbine (T) subsystem includes at least a high pressure turbine and a low pressure turbine and preferably, an intermediate pressure turbine. Unlike the prior are systems, where the intercooler was a specialized separate piece of equipment with fairly high pressure drops, the intercooler of this system is built into the HRVG reducing pressure drops, while maintaining overall efficiency of 0.9982% of the prior art, yet increasing power output due to better utilization of the heat in the heat source, i.e., the heat source stream is cooled to a low temperature in the present system than in the prior art.

The system of this invention is designed to utilize heat from heat sources having a wide range of temperatures and is designed to convert the energy of these heat sources into mechanical and/or electrical power.

The system of this invention is designed to be utilized as a bottoming cycle in a combined cycle power system, i.e., to utilize a hot exhaust stream as a heat source for example from a gas turbine. This system can also be used with any other heat source having a suitable temperature range.

The present invention broadly relates to a bottoming cycle system including a heat recovery vapor generator subsystem HRVG, a multi-stage energy conversion or turbine subsystem T and a condensation thermal compression subsystem CTCSS. The turbine subsystem T includes a high pressure turbine or turbine stage HPT and a low pressure turbine or turbine stage LPT and optionally, an intermediate pressure turbine or turbine stage IPT. The HRVG includes five sections. The lower middle two sections comprise an intercooler and optionally, a reheater section. The CTCSS can be a simple condenser or a more complex condensation thermal compression subsystem designed to more efficiently condense a multi-component working fluid. The system is designed so that a spent stream exiting the HPT of the turbine subsystem T is through the intercooler to provide additional heat for vaporing the working fluid stream and optionally, to forward a spent HPT stream to the reheater section and then to the IPT, which is in turn forwarded to the intercooler instead of the spent HPT stream.

The present invention broadly relates to a method including the step of pumping a fully condensed working fluid stream to a desired high pressure. The high pressure stream is then fed into a first or preheater section HR1 of a heat recovery vapor generator subsystem HRVG, where it is preheated by a cool heat source stream. The preheated, high pressure stream is then forwarded successively through a second section HR2 and a third section HR3 of the HRVG, which comprise an intercooler, where the preheated, high pressure stream is vaporized by a cooled heat source stream and a spent high pressure turbine or turbine stage HPT stream to form a vaporized working fluid stream. The vaporized working fluid stream is then superheated in a fourth section HR4 and a fifth section HR5 of the HRVG to form a superheated working fluid stream by a hot heat source stream. The superheated working fluid stream is then sent through into the high pressure turbine HPT, where a portion of its thermal energy is converted to mechanical and/or electrical power. The spent HPT stream after passing through the intercooler where it is cooled is sent through a low pressure turbine or turbine stage LPT, where a portion of its thermal energy is converted to mechanical and/or electrical power. The spent LPT stream is then forwarded to a condensation thermal compression subsystem (CTCSS), where it is fully condensed. Optionally, the superheated working fluid stream is first sent through an admission valve and then into the HPT. Optionally, the turbine subsystem includes an intermediate pressure turbine or turbine stage IPT. In this alternate variant, the spent HPT stream is sent through a reheater, which comprises the fifth section HR5 of the HRVG, instead of to the intercooler, and then into the IPT. A spent IPT stream then replaces the spent HPT stream and is sent into the intercooler and then into the LPT.

The working fluid used in the systems of this inventions preferably is a multi-component fluid that comprises a lower boiling point component fluid—the low-boiling component—and a higher boiling point component—the high-boiling component. Preferred working fluids include an ammonia-water mixture, a mixture of two or more hydrocarbons, a mixture of two or more freon, a mixture of hydrocarbons and freon, or the like. In general, the fluid can comprise mixtures of any number of compounds with favorable thermodynamic characteristics and solubility. In a particularly preferred embodiment, the fluid comprises a mixture of water and ammonia.

In the system of this invention, the process of intercooling is performed in a heat recovery vapor generator (HRVG). A special apparatus for intercooling is not required and as a result the economics of the system is drastically improved.

Referring now to FIG. 1, a fully condensed working solution stream S100 having parameters as at a point 29, corresponding a state of saturated liquid at ambient temperature, is sent into a feed pump FP, where it is pumped to a required high pressure to form a working solution stream S102 having parameters as at a point 100. The pressure of the stream S102 having the parameters at the point 100 can be lower or higher than the critical pressure of the working fluid.

The stream S102 having the parameters as at the point 100 then enters into an initial heat exchange section or preheater section HR1 of the HRVG. In the preheater section HR1 of the HRVG, the stream S102 having the parameters as at the point 100 is heated in counterflow by a low temperature heat source stream S104 having parameters as at a point 608, usually a low temperature flue gas stream, to form a working solution stream S106 having parameters as at a point 101 and a spent heat source stream S108 having parameters as at a point 609 in a heat exchange process 100–101 or 608–609. The stream S106 having the parameters as at the point 101 corresponds to a state of subcooled liquid.

Thereafter the stream S106 of working fluid having the parameters as at the point 101, enters into a subsequent portion HR2 of the HRVG, where further heating of the working fluid stream is provided by the heat source stream and by heat released from the intercooler as described below.

In this section HR2 of the HRVG, heat released from the intercooler is actually heating the heat source gas. This heat is then transferred from the heat source gas to the working fluid as described below. The working fluid stream S106 having the parameters as at the point 101 enters into the section HR2 of the HRVG is first heated to a state of saturated liquid (or in case of supercritical pressure, to critical temperature) in a heat exchange process 101–111 or 610–608 with a heat source stream S110 having parameters as at a point 610 forming a working fluid stream S112 having parameters as at a point 111 and the stream S104 having the parameters as at the point 608. Thereafter, the working fluid S112 having the parameters as at the point 111 is either vaporized and superheated (in cases of subcritical pressure) or is simply superheated (in cases of supercritical pressure) in a third section HR3 of the HRVG in a heat exchange process 111–102 or 607–610. In either case, the stream S112 having the parameters as at the point 111 is heated with a heat source stream S114 having parameters as at a point 607 to form a working fluid stream S116 having parameters as at a point 102 and the heat source stream S110 having parameters as at the point 610.

Simultaneously, an IPT spent working fluid stream S118 having parameters as at a point 107 enters into the intercooler portion of the HRVG which comprises the HR2 and HR3 sections of the HRVG to provide heat to the intercooler process. Upon entering the HR3 section of the HRVG, the stream S118 having the parameters as at the point 107 flows in counterflow to the stream S112 having the parameters as at the point 111 and concurrent flow with the heat source stream S114 having the parameters as at the 607. Thus, both the stream S114 and S118 provide heat to the counterflow stream S112 producing the working fluid stream S116 having the parameters as at the point 102, a cooled IPT working fluid stream S120 having parameters as at a point 110 and the heat source stream S110 having the parameters as at the point 610 in a first intercool heat exchange process 607–610, 102–111, or 107–110.

In the second section HR2 of the intercooler section of the HRVG, the cooled IPT working fluid stream S120 having the parameters as at the point 110 and the heat source stream S110 having the parameters as at the point 610 provide heat to the working fluid stream S106 having the parameters as at the point 101. In the intercooler heat exchange processes 610–608, 101–111 and 110–108, the working fluid stream S106 having the parameters as at the point 101, the cooled IPT working fluid stream S120 having the parameters as at the point 110 and the heat source stream S110 having the parameters as at the point 610 produce the working fluid stream S112 having the parameters as at the point 111, an initial LPT working fluid stream S122 having the parameters as at the point 108 and the heat source stream S104 having the parameters as at the point 608.

The total quantity of heat transferred to the working fluid stream S106 in a combined heat exchange process 101–102 is equal to a sum of heat released by the heat source in a combined heat exchange process 607–608, and heat released by the intercooler in process 107–108.

Thereafter, the working fluid stream S116 having the parameters as at the point 102 is further heated in a fourth heat exchange section HR4 of the HRVG by heat released from a counterflow heat source stream S124 having parameters as at a point 605 forming a working fluid stream S126 having parameters as at a point 103 as described below. The working fluid stream S126 having the parameters as at the point 103 is then yet further heated in a fifth section HR5 of the HRVG by a counterflow initial heat source stream S128 having the parameters as at the point 600 forming a fully vaporized and superheated working fluid stream S130 having the parameters as at the point 104, corresponding to a state of superheated vapor.

The superheated working fluid stream S130 having the parameters as at the point 104 passes through an admission valve TV1 to form an HPT addition stream S132 having the parameters as at the point 109, and enters into a high pressure turbine stage HPT of a turbine subsystem T. In the HPT, the HPT addition stream S132 having the parameters as at the point 109 is expanded to an intermediate pressure, producing mechanical power and/or electrical power, to form an HPT spent stream S134 having parameters as at a point 106.

The HPT spent stream S134 having the parameters as at the point 106 is then sent back into a high temperature section HR5, the reheater section, of the HRVG, where it is reheated in counterflow by the initial heat source stream S128 to form an initial IPT working fluid stream S136 having parameters as at a point 105. The heat released by the heat source stream S128 having the parameters as at the point 600 in heat exchange process 600–605 is utilized by both the heat exchange process 103–104 (superheating the high pressure stream of working fluid, see above) and the heat exchange process 106–105 (reheating the intermediate pressure stream of working fluid.)

The simultaneous heating and reheating of two streams S134 and S126 by the high temperature portion of the heat source stream S128 is possible because the heat from this high temperature portion of the heat source stream S128 is not used in the process of vaporization of the working fluid. Instead the heat required for vaporization of the working fluid S102 is supplied by the medium temperature portions of the heat source stream S124, S110 and S104, as well as by the heat released in the intercooler by the IPT spent stream S118 as described above.

The reheated stream S136 of working fluid having the parameters as at the point 105 enters into an intermediate pressure turbine stage IPT of the turbine subsystem T, where it is expanded, producing mechanical power and/or electrical power forming the stream S118 having the parameters as at the point 107. The stream S118 having the parameters as at the point 107, which is in a state of superheated vapor, is then sent back into the HRVG (into the intercooler sections HR3 and HR2 of the HRVG), where it passes through tubes which are parallel to tubes through which the upcoming high pressure working fluid stream S102 is flowing. In this manner, streams S118 and S120 having the parameters as at the points 107 and 101, respectively, passes in counterflow to the streams S106 and S112 having the parameters as at the points 101 or 111, respectively, (see above) and simultaneously, in parallel flow with the heat source streams S114 and S110 having the parameters as at the point 607 and 610 (see above.)

The temperature of the working fluid streams S106 and S112 in the intercooler are always higher than the temperature of the surrounding heat source streams S114 and S110. Therefore, while the heat source stream is cooled by the upcoming stream of high pressure working fluid streams S106 and S112, it is simultaneously heated by the parallel streams S118 and S120 of working fluid in the intercooler.

Note that stream S120 having the parameters as at the point 110 in the intercooler and the heat source stream S110 having the parameters as at the point 610 correspond to the boiling point of the stream S112 having the parameters as at the point 111 (or to the critical point, in the case of supercritical pressure) of the upcoming stream S106 of high pressure working fluid having the parameters as at the point 101.

Meanwhile, the working fluid stream S122 having the parameters as at the point 1.08, corresponding to a state of superheated vapor, and is sent into a low pressure turbine stage LPT of the turbine T, where it is fully expanded, producing mechanical power and/or electrical power, forming a spent working fluid stream S138 having parameters as at a point 138.

Figure 2:
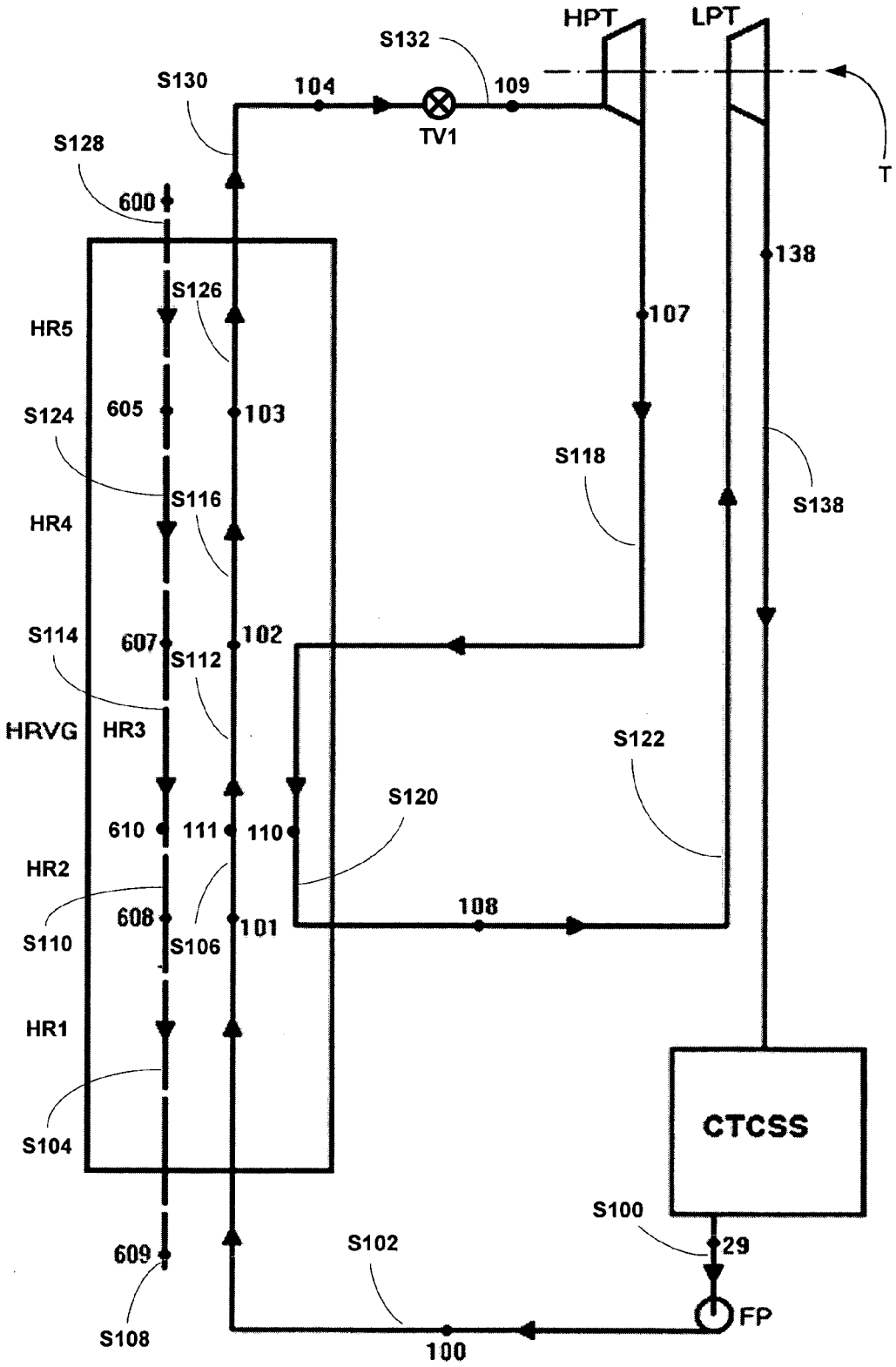
FIG. 2 depicts a block diagram of another preferred embodiment a power system of this invention.

Referring now to FIG. 2, another preferred embodiment of a bottoming cycle a fully condensed working solution stream S100 having parameters as at a point 29, corresponding a state of saturated liquid at ambient temperature, is sent into a feed pump FP, where it is pumped to a required high pressure to form a working solution stream S102 having parameters as at a point 100. In certain CTCSS variants, the feed pump FP may be redundant with the pump P3 of the CTCSS. The pressure of the stream S102 having the parameters at the point 100 can be lower or higher than the critical pressure of the working fluid.

The stream S102 having the parameters as at the point 100 then enters into an initial heat exchange section or preheater section HR1 of the HRVG. In the preheater section HR1 of the HRVG, the stream S102 having the parameters as at the point 100 is heated in counterflow by a low temperature heat source stream S104 having parameters as at a point 608, usually a low temperature flue gas stream, to form a working solution stream S106 having parameters as at a point 101 and a spent heat source stream S108 having parameters as at a point 609 in a heat exchange process 100–101 or 608–609. The stream S106 having the parameters as at the point 101 corresponds to a state of subcooled liquid.

Thereafter the stream S106 of working fluid having the parameters as at the point 101, enters into a subsequent portion HR2 of the HRVG, where further heating of the working fluid stream is provided by the heat source stream and by heat released from the intercooler as described below.

In this section HR2 of the HRVG, heat released from the intercooler is actually heating the heat source gas. This heat is then transferred from the heat source gas to the working fluid as described below. The working fluid stream S106 having the parameters as at the point 101 enters into the section HR2 of the HRVG is first heated to a state of saturated liquid (or in case of supercritical pressure, to critical temperature) in a heat exchange process 101–111 or 610–608 with a heat source stream S110 having parameters as at a point 610 forming a working fluid stream S112 having parameters as at a point 111 and the stream S104 having the parameters as at the point 608. Thereafter, the working fluid S112 having the parameters as at the point 111 is either vaporized and superheated (in cases of subcritical pressure) or is simply superheated (in cases of supercritical pressure) in a third section HR3 of the HRVG in a heat exchange process 111–102 or 607–610. In either case, the stream S112 having the parameters as at the point 111 is heated with a heat source stream S114 having parameters as at a point 607 to form a working fluid stream S116 having parameters as at a point 102 and the heat source stream S110 having parameters as at the point 610.

Simultaneously, an HPT spent working fluid stream S118 having parameters as at a point 107 enters into the intercooler portion of the HRVG which comprises the HR2 and HR3 sections of the HRVG to provide heat to the intercooler process. Upon entering the HR3 section of the HRVG, the stream S118 having the parameters as at the point 107 flows in counterflow to the stream S112 having the parameters as at the point 111 and concurrent flow with the heat source stream S114 having the parameters as at the 607. Thus, both the stream S114 and S118 provide heat to the counterflow stream S112 producing the working fluid stream S116 having the parameters as at the point 102, a cooled HPT working fluid stream S120 having parameters as at a point 110 and the heat source stream S110 having the parameters as at the point 610 in a first intercool heat exchange process 607–610, 102–111, or 107–110.

In the second section HR2 of the intercooler section of the HRVG, the cooled HPT working fluid stream S120 having the parameters as at the point 110 and the heat source stream S110 having the parameters as at the point 610 provide heat to the working fluid stream S106 having the parameters as at the point 101. In the intercooler heat exchange processes 610–608, 101–111 and 110–108, the working fluid stream S106 having the parameters as at the point 101, the cooled HPT working fluid stream S120 having the parameters as at the point 110 and the heat source stream S110 having the parameters as at the point 610 produce the working fluid stream S112 having the parameters as at the point 111, an initial LPT working fluid stream S122 having the parameters as at the point 108 and the heat source stream S104 having the parameters as at the point 608.

The total quantity of heat transferred to the working fluid stream S106 in a combined heat exchange process 101–102 is equal to a sum of heat released by the heat source in a combined heat exchange process 607–608, and heat released by the intercooler in process 107–108.

Thereafter, the working fluid stream S116 having the parameters as at the point 102 is further heated in a fourth heat exchange section HR4 of the HRVG by heat released from a counterflow heat source stream S124 having parameters as at a point 605 forming a working fluid stream S126 having parameters as at a point 103 as described below. The working fluid stream S126 having the parameters as at the point 103 is then yet further heated in a fifth section HR5 of the HRVG by a counterflow initial heat source stream S128 having the parameters as at the point 600 forming a fully vaporized and superheated working fluid stream S130 having the parameters as at the point 104, corresponding to a state of superheated vapor.

The superheated working fluid stream S130 having the parameters as at the point 104 passes through an admission valve TV1 to form an HPT addition stream S132 having the parameters as at the point 109, and enters into a high pressure turbine stage HPT of a turbine subsystem T. In the HPT, the working fluid stream S132 having the parameters as at the point 109 is expanded to an intermediate pressure, producing mechanical power and/or electrical power, to form an HPT spent stream S118 having parameters as at a point 107.

In this embodiment, the heat required for vaporization of the working fluid S102 is supplied primarily by the medium temperature portions of the heat source stream S124, S110 and S104, as well as by the heat released in the intercooler by the HPT spent stream S118 as described above.

The stream S118 having the parameters as at the point 107, which is in a state of superheated vapor, is then sent back into the HRVG (into the intercooler sections HR3 and HR2 of the HRVG), where it passes through tubes which are parallel to tubes through which the upcoming high pressure working fluid stream S102 is flowing. In this manner, streams S118 and S120 having the parameters as at the points 107 and 101, respectively, passes in counterflow to the streams S106 and S112 having the parameters as at the points 101 or 111, respectively, as described above, and simultaneously, in parallel flow with the heat source streams S114 and S110 having the parameters as at the point 607 and 610, respectively, as described above.

The temperature of the working fluid streams S106 and S112 in the intercooler are always higher than the temperature of the surrounding heat source streams S114 and S110. Therefore, while the heat source stream is cooled by the upcoming stream of high pressure working fluid streams S106 and S112, it is simultaneously heated by the parallel streams S118 and S120 of working fluid in the intercooler.

Note that stream S120 having the parameters as at the point 110 in the intercooler and the heat source stream S110 having the parameters as at the point 610 correspond to the boiling point of the stream S112 having the parameters as at the point 111 (or to the critical point, in the case of supercritical pressure) of the upcoming stream S106 of high pressure working fluid having the parameters as at the point 101.

Meanwhile, the working fluid stream S122 having the parameters as at the point 108, corresponding to a state of superheated vapor, and is sent into a low pressure turbine stage LPT of the turbine T, where it is fully expanded, producing mechanical power and/or electrical power, forming a spent working fluid stream S138 having parameters as at a point 138.

The stream S138 having the parameters as at the point 138 may then be sent directly to a condenser, or in an alternate embodiment of the proposed system, may be sent into a condensation thermal compression subsystem (CTCSS).

CTCSS Variant 1*a*

Figure 3:
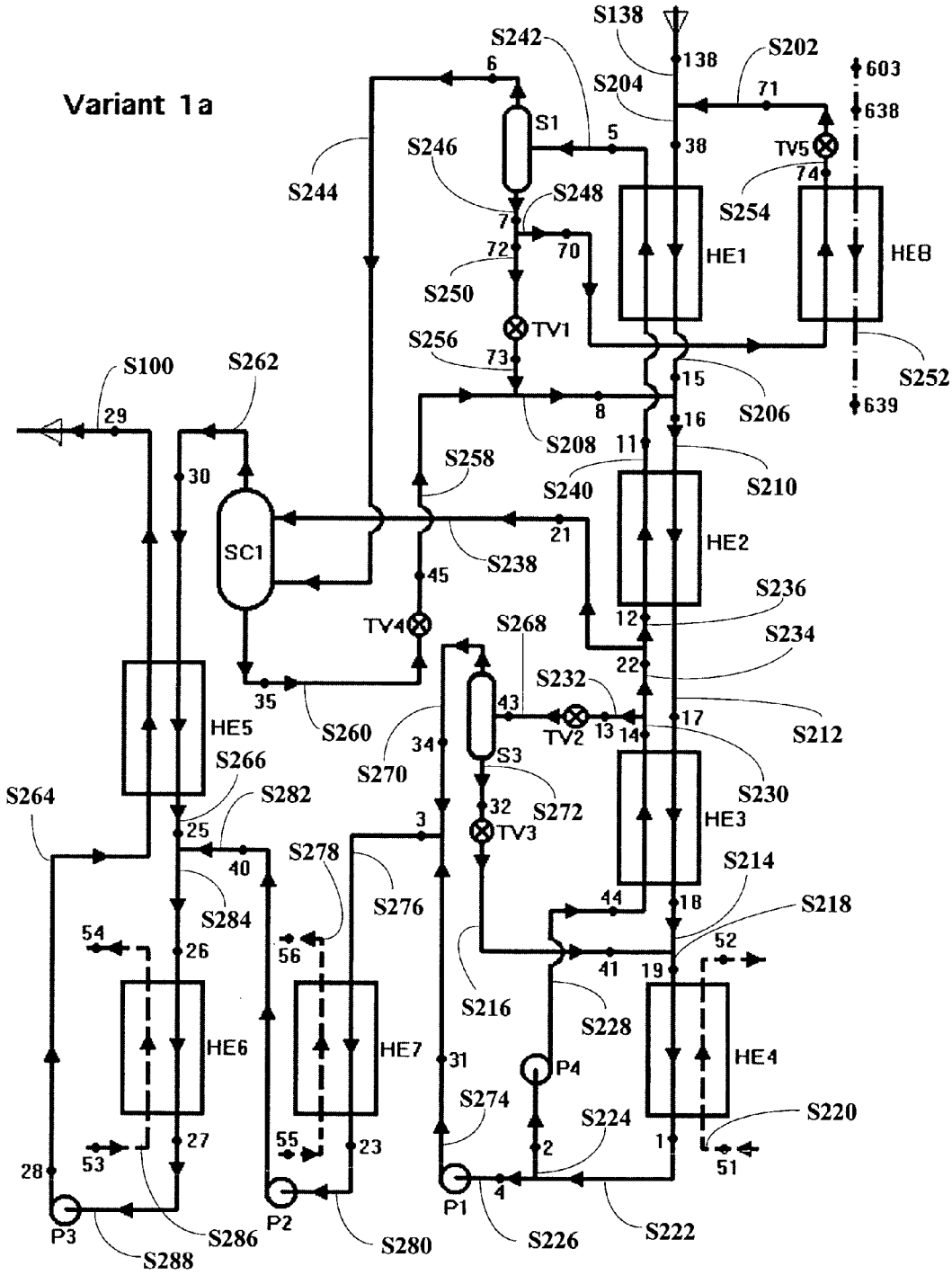
FIG. 3 depicts a block diagram of a preferred embodiment of CTCSS Variant 1*a* of a condensation and thermal compression subsystems.

Referring now to FIG. 3, a preferred embodiment of a CTCSS of this invention, generally 136, is shown and is referred to herein as Variant 1*a*. Variant 1*a* represents a very comprehensive variant of the CTCSSs of this invention.

The operation of Variant 1*a* of the CTCSS of this invention is now described.

The spent stream S138 having parameters as at a point 138, which can be in a state of superheated vapor or in a state of saturated or slightly wet vapor, enters into the CTCSS. The stream S138 having the parameters as at the point 138 is mixed with a first mixed stream S202 having parameters as at a point 71, which is in a state of a liquid-vapor mixture (as describe more fully herein), forming a first combined stream S204 having parameters as at a point 38. If the stream S138 having the parameters as at the point 138 is in a state of saturated vapor, then a temperature of the stream S202 having the parameters as at the point 71 must be chosen in such a way as to correspond to a state of saturated vapor. As a result, the stream S204 having the parameters as at the point 38 will be in a state of a slightly wet vapor. Alternatively, if the stream S138 having the parameters as at the point 138 is in a state of superheated vapor, then stream S202 having the parameters of at the point 71 must be chosen in such a way that the resulting stream S204 having the parameters as at a point 38 should be in, or close to, a state of saturated vapor, where close to means the state of the vapor is within 5% of the saturated vapor state for the vapor. In all cases, the parameters of the stream S202 at the point 71 are chosen in such a way as to maximize a temperature of the stream S204 at the point 38.

Thereafter, the stream S204 having the parameters as at the point 38 passes through a first heat exchanger HE1, where it is cooled and partially condensed and releases heat in a first heat exchange process, producing a second mixed stream S206 having parameters as at a point 15. The stream S206 having the parameters as at the point 15 is then mixed with a stream S208 having parameters as at a point 8, forming a stream S210 having parameters as at a point 16. In the preferred embodiment of this system, the temperatures of the streams S208, S206 and S210 having parameters of the points 8, 15, and 16, respectively, are equal or very close, within about 5%. A concentration of the low-boiling component in stream S208 having the parameters as at the point 8 is substantially lower than a concentration of the low boiling component in the stream S206 having the parameters as at the point 15. As a result, a concentration of the low boiling component in the stream S210 having the parameters as at the point 16 is lower than the concentration of the low boiling component of the stream S206 having the parameters as at the point 15, i.e., stream S210 having the parameters as at the point 16 is leaner than stream S206 having the parameters as at the point 15.

The stream S210 having the parameters as at the point 16 then passes through a second heat exchanger HE2, where it is further condensed and releasing heat in a second heat exchange process, forming a stream S212 having parameters as at a point 17. The stream S212 having the parameters as at the point 17 then passes through a third heat exchanger HE3, where it is further condensed in a third heat exchange process to form a stream S214 having parameters as at a point 18. At the point 18, the stream S214 is partially condensed, but its composition, while substantially leaner that the compositions of the stream S138 and S204 having the parameters as at the points 138 and 38, is such that it cannot be fully condensed at ambient temperature. The stream S214 having the parameters as at the point 18 is then mixed with a stream S216 having parameters as at a point 41, forming a stream S218 having parameters as at a point 19. The composition of the stream S218 having the parameters as at the point 19 is such that it can be fully condensed at ambient temperature.

The stream S218 having the parameters as at the point 19 then passes through a low pressure condenser HE4, where it is cooled in a fourth heat exchange process in counterflow with a stream S220 of cooling water or cooling air having initial parameters as at a point 51 and final parameters as at a point 52, becoming fully condensed, to form a stream S222 having parameters as at a point 1. The composition of the stream S222 having the parameters as at the point 1, referred to herein as the "basic solution," is substantially leaner than the composition of the stream S138 having the parameters at the point 138, which entered the CTCSS. Therefore, the stream S222 having the parameters as at the point 1 must be distilled at an elevated pressure in order to produce a stream having the same composition as at point 138, but at an elevated pressure that will allow the stream to fully condense.

The stream S222 having the parameters as at the point 1 is then divided into two substreams S224 and S226 having parameters as at points 2 and 4, respectively. The stream S224 having the parameters as at the point 2 enters into a circulating fourth pump P4, where it is pumped to an elevated pressure forming a stream S228 having parameters as at a point 44, which correspond to a state of subcooled liquid. Thereafter, the stream S228 having the parameters as at the point 44 passes through a third heat exchanger HE3 in counterflow with the stream S212 having the parameters as at the point 17 in a third heat exchange process as described above, is heated forming a stream S230 having parameters as at a point 14. The stream S230 having the parameters as at the point 14 is in, or close to, a state of saturated liquid. Again, the term close to means that the state of the stream S230 is within 5% of being a saturated liquid. Thereafter, the stream S230 having parameters as at point 14 is divided into two substreams S232 and S234 having parameters as at points 13 and 22, respectively. The stream S234 having the parameters as at the point 22 is then divided into two substreams S236 and S238 having parameters as at points 12 and 21, respectively. The stream S236 having the parameters as at the point 12 then passes through the second heat exchanger HE2, where it is heated and partially vaporized in counterflow to the stream S210 having the parameters as at the point 16 as described above in a second heat exchange process, forming a stream S240 having parameters as at a point 11. The stream S240 having the parameters as at the point 11 then passes through the first heat exchanger HE1, where it is further heated and vaporized in counterflow to the stream S204 having stream 38 as described above in a first heat exchange process, forming a stream S242 having parameters as at a point 5.

The stream S242 having the parameters as at the point 5, which is in a state of a vapor-liquid mixture, enters into a first separator S1, where it is separated into a saturated vapor stream S244 having parameters as at a point 6 and saturated liquid stream S246 having parameters as at a point 7.

The liquid stream S246 having the parameters as at the point 7 is divided into two substreams S248 and S250 having parameters as at points 70 and 72, respectively. The stream S248 having the parameters as at the point 70, then passes through an eighth heat exchanger HE8, where it is heated and partially vaporized in an eighth heat exchange process, in counterflow to an external heat carrier stream S252 having initial parameters as a point 638 and final parameters as at a pint 639, forming a stream S254 having parameters as at a point 74. Thereafter, stream S254 having the parameters as at the point 74 passes through a fifth throttle valve TV5, where its pressure is reduced to a pressure equal to a pressure of the stream S138 having the parameters as at the point 138, forming the stream S202 having the parameters as at the point 71. Thereafter, the stream S202 having the parameters as at the point 71 is mixed with the stream S138 having the parameters as at the point 138, forming the stream S204 having the parameters as at the point 38 as previously described.

The stream S250 having parameters as at point 72, then passes through a first throttle valve TV1, where its pressure is reduced, forming a stream S256 having parameters as at a point 73. The pressure of the stream S256 having the parameters as at the point 73 is equal to a pressure of the streams S206, S208, and S210 having the parameters as at the points 15, 8 and 16. Thereafter the stream S256 having the parameters as at the point 73 is mixed with a stream S258 having parameters as at a point 45, forming the stream S208 having the parameters as at the point 8. The stream S208 having the parameters as a the point 8 is then mixed with the stream S206 having the parameters as at the point 15, forming the stream S210 having the parameters as at the point 16 as described above.

Meanwhile, the vapor stream S244 having the parameters as at the point 6 is sent into a bottom part of a first scrubber SC1, which is in essence a direct contact heat and mass exchanger. At the same time, the stream S238 having the parameters as at the point 21 as described above, is sent into a top portion of the first scrubber SC1. As a result of heat and mass transfer in the first scrubber SC1, a liquid stream S260 having parameters as at a point 35, which is in a state close to equilibrium (close means within about 5% of the parameters of the stream S244) with the vapor stream S244 having the parameters as at the point 6, is produced and removed from a bottom of the first scrubber SC1. At the same time, a vapor stream S262 having parameters as at point 30, which is in a state close to equilibrium with the liquid stream S238 having the parameters as at the point 21, exits from a top of the scrubber SC1.

The vapor stream S262 having the parameters as at the point 30 is then sent into a fifth heat exchanger HE5, where it is cooled and partially condensed, in counterflow with a stream S264 of working fluid having parameters as at a point 28 in a fifth heat exchange process, forming a stream S266 having parameters as at a point 25.

The liquid stream S260 having the parameters as at the point 35 is removed from the bottom of the scrubber SC1 and is sent through a fourth throttle valve TV4, where its pressure is reduced to a pressure equal to the pressure of the stream S256 having the parameters as at the point 73, forming the stream S258 having the parameters as at the point 45. The stream S258 having the parameters as at the point 45 is then mixed with the stream S256 having the parameters as at the point 73, forming the stream S208 having the parameters as at the point 8 as described above.

The liquid stream S232 having the parameters as at the point 13, which has been preheated in the third heat exchanger HE3 as described above, passes through a second throttle valve TV2, where its pressure is reduced to an intermediate pressure, (i.e., a pressure which is lower than the pressure of the stream S230 having the parameter as at the point 14, but higher than the pressure of the stream S222 having the parameters as at the point 1), forming a stream S268 parameters as at a point 43, corresponding to a state of a vapor-liquid mixture. Thereafter, the stream S268 having the parameters as at the point 43 is sent into a third separator S3, where it is separated into a vapor stream S270 having parameters as at a point 34 and a liquid stream S272 having parameters as at a point 32.

A concentration of the low boiling component in the vapor stream S270 having the parameters as at the point 34 is substantially higher than a concentration of the low boiling component in the stream S138 having the parameters as at the point 138 as it enters the CTCSS as described above. The liquid stream S272 having the parameters as at the point 32 has a concentration of low boiling component which is less than a concentration of low boiling component in the stream S222 having the parameters as at the point 1 as described above.

The liquid stream S226 of the basic solution having the parameters as at the point 4 as described above, enters into a first circulating pump P1, where it is pumped to a pressure equal to the pressure of the stream S270 having the parameters as at the point 34, forming a stream S274 having parameters as at a point 31 corresponding to a state of subcooled liquid. Thereafter, the subcooled liquid stream S274 having the parameters as at the point 31 and the saturated vapor stream S270 having the parameters as at the point 34 are combined, forming a stream S276 having parameters as at a point 3. The stream S276 having the parameters as at the point 3 is then sent into an intermediate pressure condenser or a seventh heat exchanger HE7, where it is cooled and fully condensed in a seventh heat exchange process, in counterflow with a stream S278 of cooling water or air having initial parameters as at a point 55 and having final parameters as at a point 56, forming a stream S280 having parameters as at a point 23. The stream S280 having parameters as at point 23 then enters into a second circulating pump P2, where its pressure is increased to a pressure equal to that of the stream S266 having the parameters as at the point 25 as described above, forming a stream S282 parameters as at a point 40. The stream S282 having the parameters as at the point 40 is then mixed with the stream S266 having the parameters as at the point 25 as described above, forming a stream S284 having parameters as at a point 26. The composition and flow rate of the stream S282 having the parameters as at the point 40 are such that the stream S284 having the parameters as at the point 26 has the same composition and flow rate as the stream S138 having the parameters as at the point 138, which entered the CTCSS, but has a substantially higher pressure.

Thereafter, the stream S284 having the parameters as at the point 26 enters into a high pressure condenser or sixth heat exchanger HE6, where it is cooled and fully condensed in a sixth heat exchange process, in counterflow with a stream S286 of cooling water or air having initial parameters as at a point 53 and final parameters as at a point 54, forming a steam S288 parameters as at a point 27, corresponding to a state of saturated liquid. The stream S288 having the parameters as at the point 27 then enters into a third or feed pump P3, where it is pumped to a desired high pressure, forming the stream S264 having the parameters as at the point 28. Then the stream S264 of working fluid having the parameters as at the point 28 is sent through the fifth heat exchanger HE5, where it is heated, in counterflow with the stream S262 having the parameters as at the point 30 in the fifth heat exchange process, forming a stream S290 having parameters as at a point 29 as described above. The stream S290 having the parameters as at a point 29 then exits the CTCSS, and returns to the power system. This CTCSS of this invention is closed in that no material is added to any stream in the CTCSS.

Figure 4:
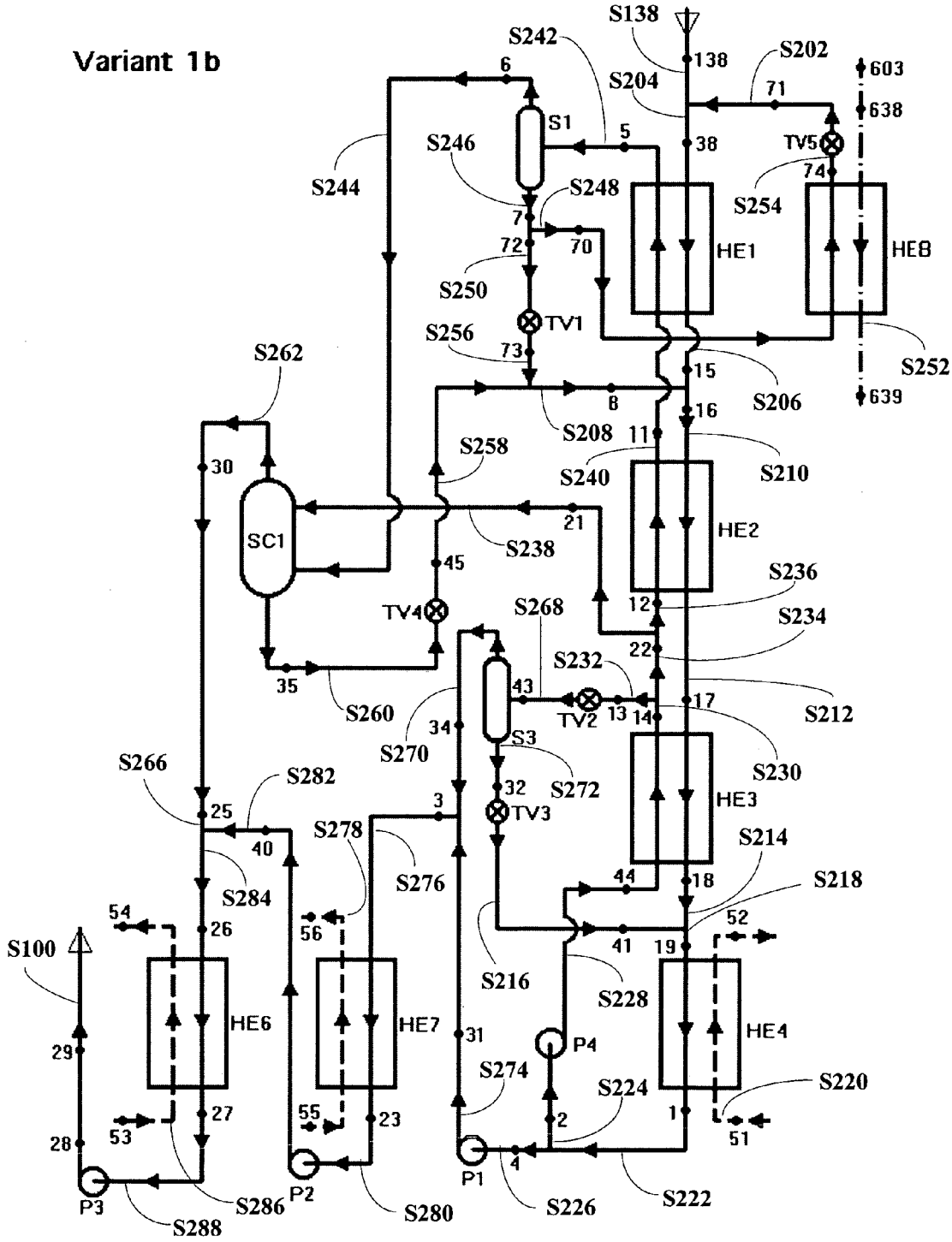
FIG. 4 depicts a block diagram of another preferred embodiment of CTCSS Variant 1*b* of a condensation and thermal compression subsystems.

In some cases, preheating of the working fluid which is reproduced in the CTCSS is not necessary. In such cases, the fifth heat exchanger HE5 is excluded from the Variant 1*a* described above. As a result, the stream S262 having the parameters as at the point 30 and the stream S266 having the parameters as at the point 25 are the same, and the stream S264 having the parameters at the point 28 are the stream S290 having the parameters as at the point 29 are the same as shown in FIG. 4. The CTCSS system in which HE5 is excluded is referred to as Variant 1*b*.

The CTCSSs of this invention provide highly effective utilization of heat available from the condensing stream S138 of the working solution having the parameters as at the point 138 and of heat from external sources such as from the stream S252.

In distinction from an analogous system described in the prior art, the lean liquid stream S246 having the parameters as at the point 7 coming from the first separator S1, is not cooled in a separate heat exchanger, but rather a portion of the stream S246 is injected into the stream S138 of working fluid returning from the power system.

When the stream S236 of basic solution having the parameters as at the point 12 starts to boil, it initially requires a substantial quantity of heat, while at the same time its rise in temperature is relatively slow. This portion of the reboiling process occurs in the second heat exchanger HE2. In the process of further reboiling, the rate of increase in the temperatures becomes much faster. This further portion of the reboiling process occurs in the first heat exchanger HE1. At the same time, in the process of condensation of the stream S204 having the parameters as at the point 38, initially a relatively large quantity of heat is released, with a relatively slow reduction of temperature. But in further condensation, the rate of reduction of temperature is much higher. As a result of this phenomenon, in the prior art, the temperature differences between the condensing stream of working solution and the reboiling stream of basic solution are minimal at the beginning and end of the process, but are quite large in the middle of the process.

In contrast to the prior art, in the CTCSS of this invention, the concentration of the low boiling component in stream S208 having the parameters as at the point 8 is relatively low and therefore in the second heat exchanger HE2, stream S208 having the parameters as at the point 8 not only condenses itself, but has the ability to absorb additional vapor. As a result, the quantity of heat released in the second heat exchanger HE2 in the second heat exchange process is substantially larger than it would be if streams S208 and S206 having the parameters as at the points 8 and 15, respectively, were cooled separately and not collectively collect after combining the two stream S208 and S206 to form the stream S210. As a result, the quantity of heat available for the reboiling process comprising the first and second heat exchange processes is substantially increased, which in turn increases the efficiency of the CTCSS system.

The leaner the stream S208 having the parameters at as the point 8 is, the greater its ability to absorb vapor, and the greater the efficiency of the heat exchange processes occurring in the first and second heat exchangers HE1 and HE2. But the composition of the stream S208 having the parameters at as the point 8 is defined by the temperature of the stream S242 having the parameters as at the point 5; the higher the temperature of the stream S242 having the parameters as at the point 5, the leaner the composition of stream S208 having the parameters at as the point 8 can be.

It is for this reason that external heat derived from stream S252 is used to heat stream S248 having the parameters as at the point 70, thus raising the temperature of the stream S204 having the parameters as at the point 38, and as a result also raising the temperature of the stream S242 having the parameters as at the point 5. However, increasing of the temperature of the stream S242 having the parameters as at the point 5, and correspondingly the temperature of the stream S244 having the parameters as at a point 6, leads to a reduction in a concentration of the low boiling component in the vapor stream S244 having the parameters as at the point 6.

Use of the scrubber SC1, in place of a heat exchanger, for the utilization of heat from the stream S244 having the parameters as at the point 6 allows both the utilization of the heat from the stream S244 having the parameters as at the point 6 and an increase of the concentration of low boiling component in the produced vapor stream S262 having the parameters as at the point 30.

The vapor stream S262 having the parameters as at the point 30 has a concentration of low-boiling component which is higher than the concentration of the low boiling component in the vapor stream S244 having the parameters as at the point 6, and the flow rate of stream S262 having the parameters as at the point 30 is higher than the flow rate of the stream S244 having the parameters as at the point 6.

The concentration of low boiling component in the working fluid is restored in the stream S284 having the parameters at the point 26, by mixing the stream S266, a very rich solution, having the parameters as at the point 25 (or the stream S262 having the parameters as at the point 30, in the case of the Variant 1*b*), with the stream S282 having the parameters as at the point 40. The stream S282 having the parameters as at point 40 has a higher concentration of low boiling component than the basic solution, (i.e., is enriched). Such an enrichment has been used in the prior art, but in the prior art, in order to obtain this enrichment, a special intermediate pressure reboiling process is needed requiring several additional heat exchangers.

In the CTCSSs of this invention, all heat that is available at a temperature below the boiling point of the basic solution (i.e., below the temperature of the stream S230 having the parameters as at the point 14) is utilized in a single heat exchanger, the third heat exchanger HE3. Thereafter, the vapor needed to produce the enriched stream S282 having the parameters as at the point 40 is obtained simply by throttling the stream S232 having the parameters as at the point 13.

In U.S. Pat. No. 5,572,871, a DCSS (distilation condensation subsystem) required 13 heat exchangers and three separators, and did not provide for the potential utilization of external heat. In contrast, the CTCSS of the present invention, which does provide for the utilization of external heat, requires only eight heat exchangers, two separators and one scrubber (which is substantially simpler and less expensive than a heat exchanger.)

A table of example parameters of all points for variant 1*b* is presented in Table 1.

TABLE 1

CTCSS State Points Summary (Variant 1b)

| Point | X (lb/lb) | T (° F.) | P (psia) | H (Btu/lb) | S (Btu/lb-R) | G rel (G/G = 1) | Phase | Wetness (lb/lb/) or T (° F.) |
|---|---|---|---|---|---|---|---|---|
| | | | | Working Fluid | | | | |
| 01 | 0.4640 | 65.80 | 30.772 | −72.3586 | 0.0148 | 8.39248 | Mix | 1 |
| 02 | 0.4640 | 65.97 | 73.080 | −72.0625 | 0.0151 | 8.39248 | Liq | −45.53° F. |
| 03 | 0.6635 | 103.77 | 73.080 | 180.1339 | 0.4592 | 0.49176 | Mix | 0.6584 |
| 04 | 0.4640 | 65.97 | 73.080 | −72.0625 | 0.0151 | 8.08657 | Liq | −45.53° F. |
| 05 | 0.4640 | 191.03 | 100.823 | 234.3143 | 0.5229 | 1.83999 | Mix | 0.7351 |
| 06 | 0.9337 | 191.03 | 100.823 | 662.3343 | 1.2517 | 0.48733 | Mix | 0 |
| 07 | 0.2948 | 191.03 | 100.823 | 80.1075 | 0.2603 | 1.35266 | Mix | 1 |
| 08 | 0.2948 | 143.93 | 34.772 | 80.1074 | 0.2651 | 1.34681 | Mix | 0.93 |
| 11 | 0.4640 | 137.27 | 102.823 | 24.6957 | 0.1857 | 1.83999 | Mix | 0.9707 |
| 12 | 0.4640 | 133.62 | 104.823 | 2.9022 | 0.1490 | 1.83999 | Mix | 1 |
| 13 | 0.4640 | 133.62 | 104.823 | 2.9022 | 0.1490 | 5.99531 | Mix | 1 |
| 14 | 0.4640 | 133.62 | 104.823 | 2.9022 | 0.1490 | 8.08657 | Mix | 1 |
| 15 | 0.7277 | 143.93 | 34.772 | 463.0612 | 0.9967 | 1.23621 | Mix | 0.2994 |
| 16 | 0.5020 | 143.93 | 34.772 | 263.3857 | 0.6153 | 2.58302 | Mix | 0.6282 |
| 17 | 0.5020 | 138.62 | 33.772 | 247.8614 | 0.5906 | 2.58302 | Mix | 0.6417 |
| 18 | 0.5020 | 76.28 | 32.772 | 13.9449 | 0.1776 | 2.58302 | Mix | 0.8841 |
| 19 | 0.4640 | 80.93 | 32.772 | −6.8178 | 0.1376 | 8.39248 | Mix | 0.9257 |
| 21 | 0.4640 | 131.71 | 100.823 | 2.9022 | 0.1490 | 0.25126 | Mix | 0.9964 |
| 22 | 0.4640 | 133.62 | 104.823 | 2.9022 | 0.1490 | 2.09125 | Mix | 1 |

TABLE 1-continued

CTCSS State Points Summary (Variant 1b)

| Point | X (lb/lb) | T (° F.) | P (psia) | H (Btu/lb) | S (Btu/lb-R) | G rel (G/G = 1) | Phase | Wetness (lb/lb/) or T (° F.) |
|---|---|---|---|---|---|---|---|---|
| 23 | 0.6635 | 65.80 | 71.080 | −56.4301 | 0.0224 | 0.49176 | Mix | 1 |
| 24 | 0.9337 | 191.03 | 100.823 | 662.3343 | 1.2517 | 0.48733 | Mix | 0 |
| 25 | 0.9911 | 131.71 | 100.823 | 600.2216 | 1.1578 | 0.50824 | Mix | 0 |
| 26 | 0.8300 | 87.68 | 100.823 | 277.4277 | 0.6017 | 1.00000 | Mix | 0.4842 |
| 27 | 0.8300 | 65.80 | 98.823 | −17.0503 | 0.0497 | 1.00000 | Mix | 1 |
| 28 | 0.8300 | 70.73 | 1,900.000 | −7.8325 | 0.0525 | 1.00000 | Liq | −256.82° F. |
| 29 | 0.8300 | 70.73 | 1,900.000 | −7.8325 | 0.0525 | 1.00000 | Liq | −256.82° F. |
| 30 | 0.9911 | 131.71 | 100.823 | 600.2216 | 1.1578 | 0.50824 | Mix | 0 |
| 31 | 0.4640 | 65.97 | 73.080 | −72.0625 | 0.0151 | 0.30591 | Liq | −45.53° F. |
| 32 | 0.4471 | 116.52 | 73.080 | −16.0494 | 0.1167 | 5.80941 | Mix | 1 |
| 34 | 0.9919 | 116.52 | 73.080 | 595.1359 | 1.1849 | 0.18590 | Mix | 0 |
| 35 | 0.2948 | 191.03 | 100.823 | 80.1075 | 0.2603 | 0.23036 | Mix | 1 |
| 38 | 0.7277 | 196.03 | 35.772 | 775.0604 | 1.4862 | 1.23621 | Vap | 0° F. |
| 40 | 0.6635 | 65.96 | 100.823 | −56.1779 | 0.0227 | 0.49176 | Liq | −19.53° F. |
| 41 | 0.4471 | 82.91 | 32.772 | −16.0494 | 0.1196 | 5.80941 | Mix | 0.9442 |
| 43 | 0.4640 | 116.52 | 73.080 | 2.9022 | 0.1498 | 5.99531 | Mix | 0.969 |
| 44 | 0.4640 | 66.12 | 109.823 | −71.8156 | 0.0153 | 8.08657 | Liq | −70.52° F. |
| 45 | 0.2948 | 143.93 | 34.772 | 80.1075 | 0.2651 | 0.23036 | Mix | 0.93 |
| 70 | 0.2948 | 191.03 | 100.823 | 80.1075 | 0.2603 | 0.23621 | Mix | 1 |
| 71 | 0.2948 | 227.10 | 35.772 | 615.2057 | 1.0815 | 0.23621 | Mix | 0.4122 |
| 72 | 0.2948 | 191.03 | 100.823 | 80.1075 | 0.2603 | 1.11645 | Mix | 1 |
| 73 | 0.2948 | 143.93 | 34.772 | 80.1075 | 0.2651 | 1.11645 | Mix | 0.93 |
| 74 | 0.2948 | 284.54 | 98.823 | 615.2060 | 1.0182 | 0.23621 | Mix | 0.4545 |
| 138 | 0.8300 | 358.47 | 35.772 | 812.8197 | 1.5611 | 1.00000 | Vap | 181.2° F. |
| External Heat Source | | | | | | | | |
| 638 | AIR | 351.74 | 12.976 | 99.4176 | 0.5970 | 3.83489 | Vap | 666.2° F. |
| 639 | AIR | 216.03 | 12.904 | 66.4582 | 0.5529 | 3.83489 | Vap | 530.5° F. |
| Coolant | | | | | | | | |
| 51 | water | 51.80 | 24.693 | 19.9498 | 0.0396 | 27.3421 | Liq | −187.56° F. |
| 52 | water | 71.93 | 14.693 | 40.0672 | 0.0783 | 27.3421 | Liq | −140.03° F. |
| 53 | water | 51.80 | 24.693 | 19.9498 | 0.0396 | 13.6854 | Liq | −187.56° F. |
| 54 | water | 73.33 | 14.693 | 41.4676 | 0.0809 | 13.6854 | Liq | −138.63° F. |
| 55 | water | 51.80 | 24.693 | 19.9498 | 0.0396 | 3.07700 | Liq | −187.56° F. |
| 56 | water | 89.63 | 14.693 | 57.7573 | 0.1110 | 3.07700 | Liq | −122.32° F. |

The CTCSSs of this invention can be simplified by eliminating some "modular" components. For instance, it is possible to enrich the stream S282 having the parameters as at the point 40 without using the intermediate pressure condenser, the seventh heat exchanger HE7. Such a system, with preheating of the stream S264 of working fluid having the parameters as at the point 28 is shown in FIG. 3, and referred to as Variant 2*a*. A similar system, but without preheating the stream S264 of working fluid having the parameters as at the point 28, is shown in FIG. 4, and referred to as Variant 2*b*.

In the Variant 2*a* and Variant 2*b*, in distinction to the Variant 1*a* and Variant 1*b*, the pressure of the stream S268 having the parameters as at the point 43 is chosen in such a way that the when mixing the vapor stream S270 having the parameters as at the point 34 and the liquid stream S274 having the parameters as at the point 31, the subcooled liquid stream S274 having the parameters as at the point 31 fully absorbs the vapor stream S270 having the parameters as at the point 34, and the resulting stream S276 having the parameters as at the point 3 is in a state of saturated, or slightly subcooled, liquid. Thereafter, the liquid S276 having the parameters as at the point 3 is sent into the second pump P2, to form the stream S282 having the parameters as at the point 40, and is mixed with stream 25.

The simplification of the CTCSS of Variant 2*a* and Variant 2*b* reduces the overall efficiency of the CTCSSs of this invention, but at the same time, the cost is also reduced.

Figure 5:
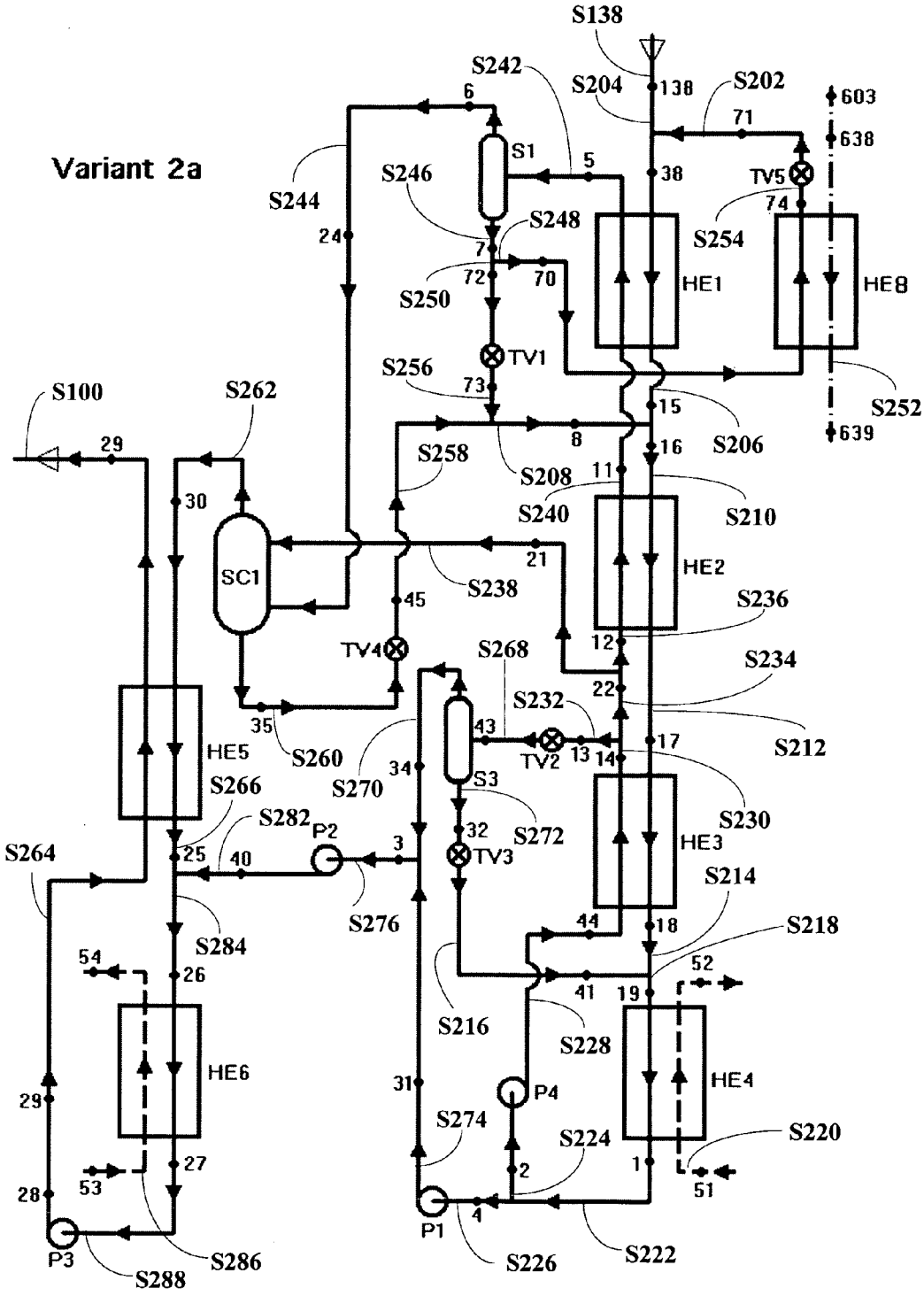
FIG. 5 depicts a block diagram of a preferred embodiment of CTCSS Variant 2*a* of a condensation and thermal compression subsystems.
Figure 6:
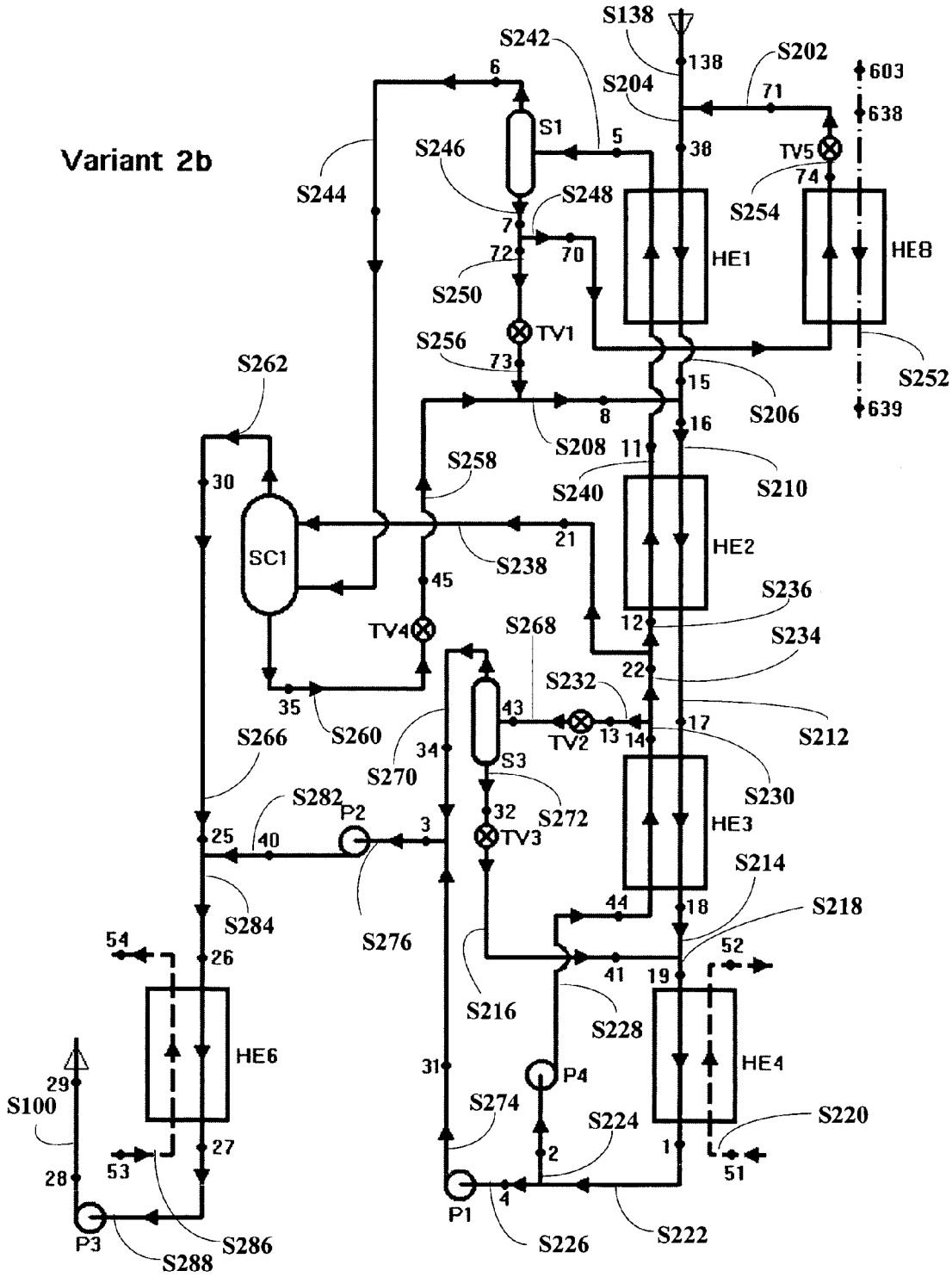
FIG. 6 depicts a block diagram of a preferred embodiment of CTCSS Variant 2*b* of a condensation and thermal compression subsystems.

Another possible modular simplification of the Variant 1*a* and Variant 1*b* can be used in a case where external heat is not available, or the choice is made not to utilize external heat. Such a variant of the CTCSS of this invention, with preheating of the stream S264 of working fluid having the parameters as at the point 28 is shown in FIG. 5, and is referred to as Variant 3*a*. A similar CTCSS of this invention, but without preheating the stream S264 of the working fluid having the parameters as at the point 28, is shown in FIG. 6, and referred to as Variant 3*b*.

In Variant 3*a* and Variant 3*b*, the stream S248 having the parameters as at the point 70 is not heated, but rather simply passes through the fifth throttle valve TV5, to form the stream S202 having the parameters as at the point 71, and is then mixed with the stream S138 having the parameters as at the point 138, forming the stream S204 having the parameters as at the point 38. This mixing process is used only in a case where the stream S138 having the parameters as at the point 138 is in a state of superheated vapor. The flow rate of streams S248 and S202 having the parameters as at the points 70 and 71 is chosen in such a way that the stream S204 having the parameters as at the point 38 formed as a result of mixing the stream S202 having the parameters as at the point 71 and the stream S138 having the parameters as at the point 138 is in a state of saturated, or slightly wet, vapor.

Figure 7:
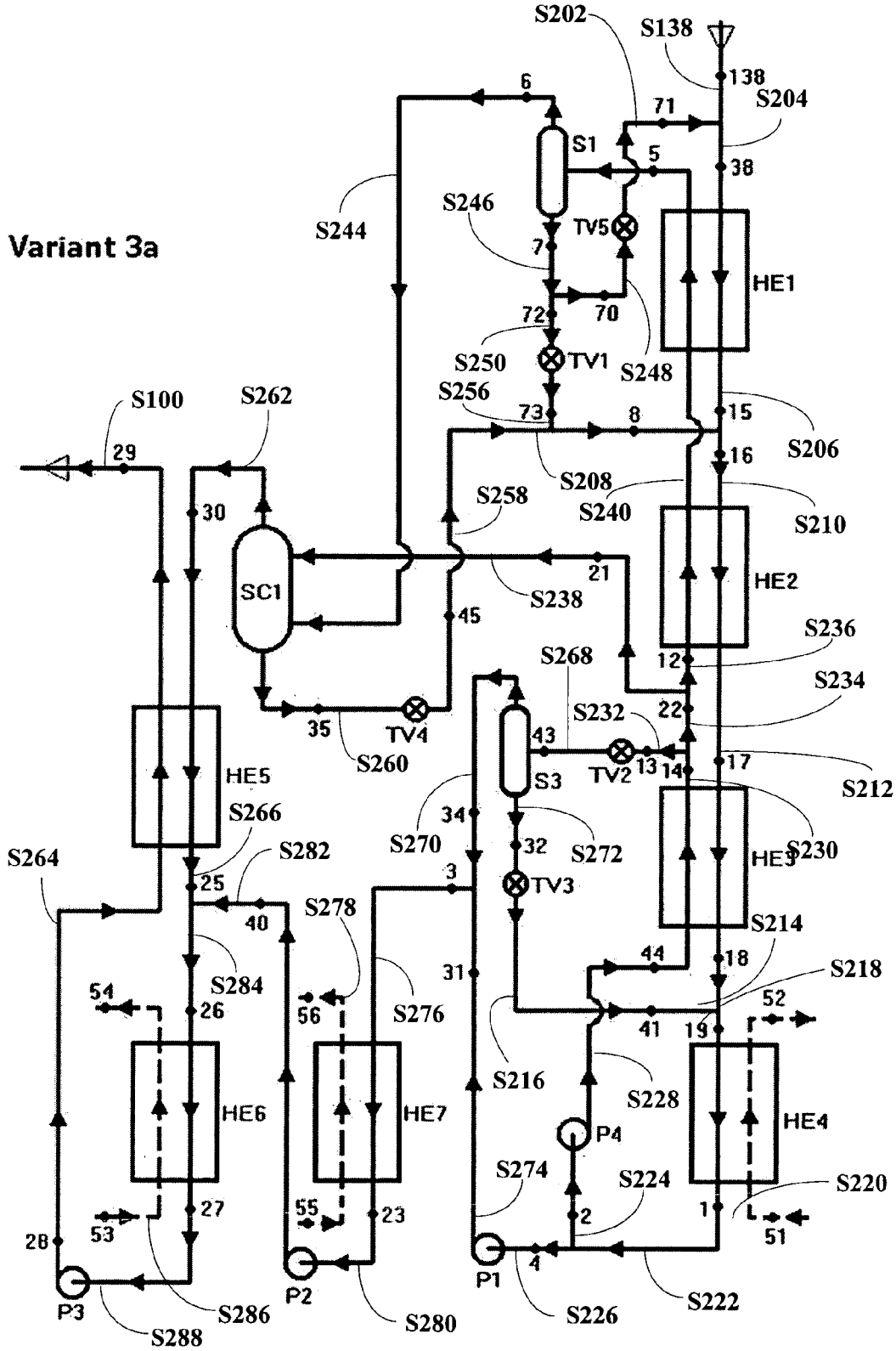
FIG. 7 depicts a block diagram of a preferred embodiment of CTCSS Variant 3*a* of a condensation and thermal compression subsystems.
Figure 8:
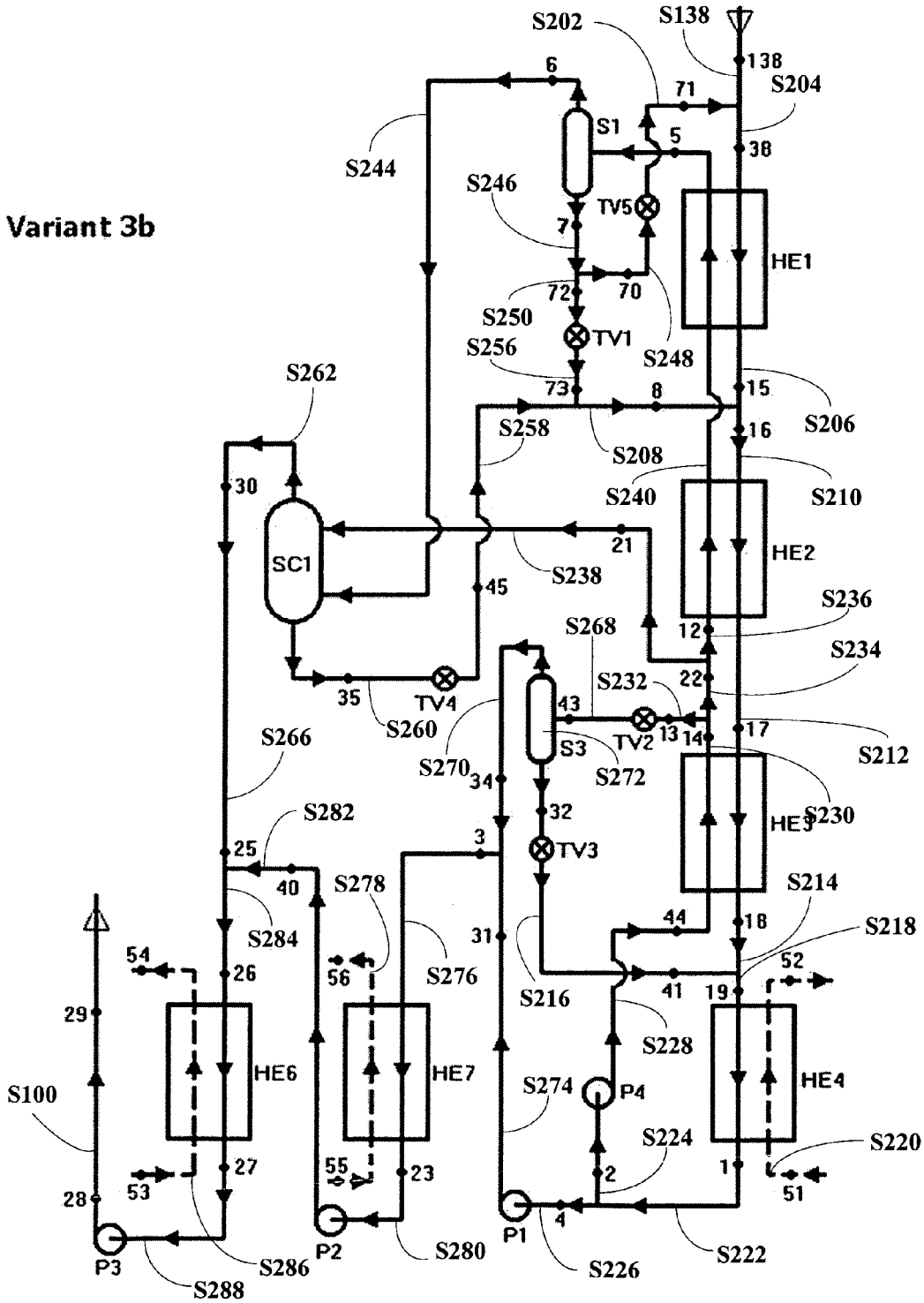
FIG. 8 depicts a block diagram of a preferred embodiment of CTCSS Variant 3*b* of a condensation and thermal compression subsystems.

It is also possible to simplify Variant 2*a* and Variant 2*b* in the same manner than Variant 1*a* and Variant 1*b* are simplified to obtain Variant 3*a* and Variant 3*b*. This modular simplification of Variant 2*a* and Variant 2*b*, with preheating of the stream S264 of the working fluid having the parameters as at the point 28 is shown in FIG. 7, and is referred to as Variant 4*a*; while a similar simplification of Variant 2*b*, without preheating the stream S264 of the working fluid having the parameters as at the point 28, is shown in FIG. 8, and referred to as Variant 4*b*.

Figure 9:
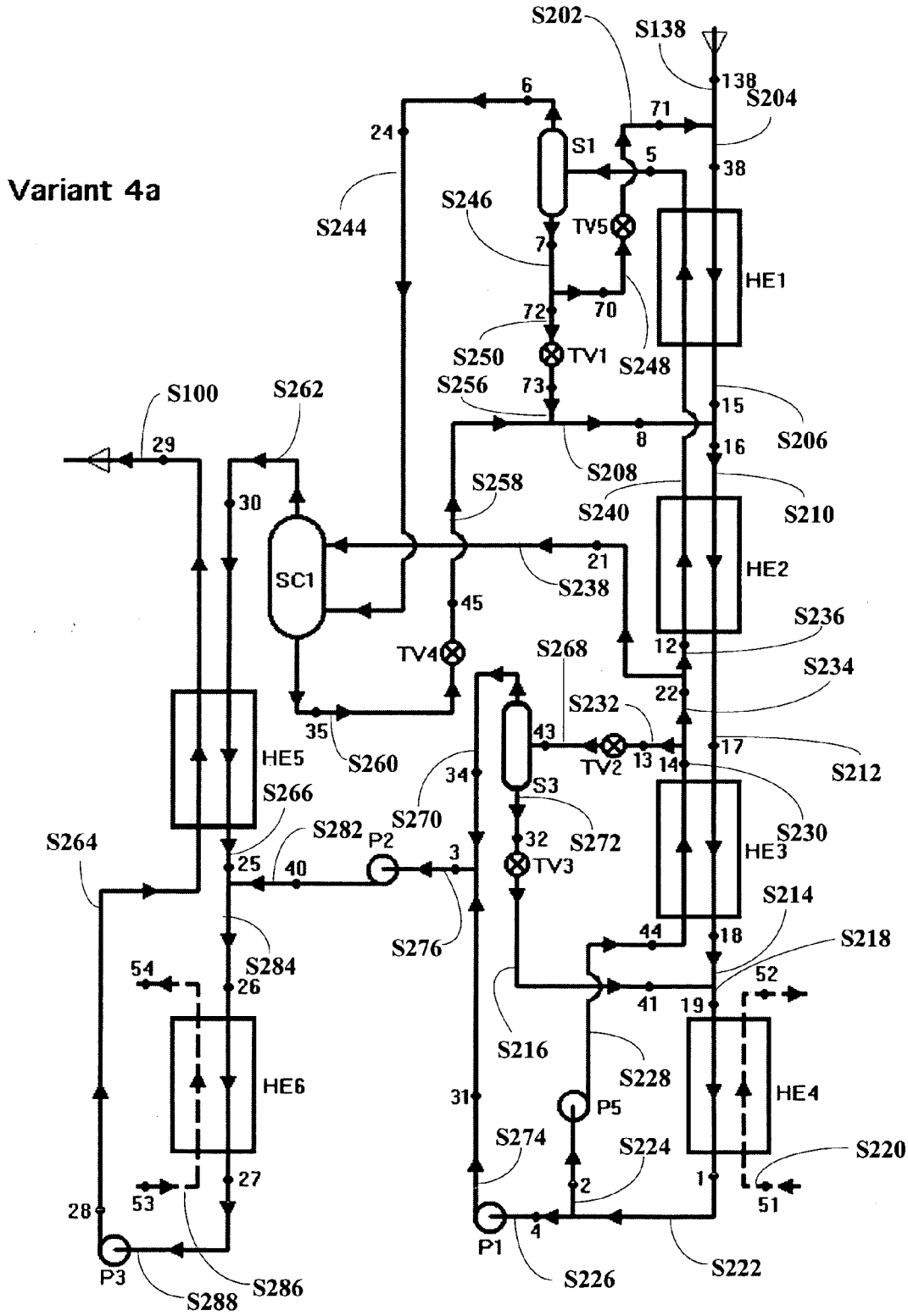
FIG. 9 depicts a block diagram of a preferred embodiment of CTCSS Variant 4*a* of a condensation and thermal compression subsystems.
Figure 10:
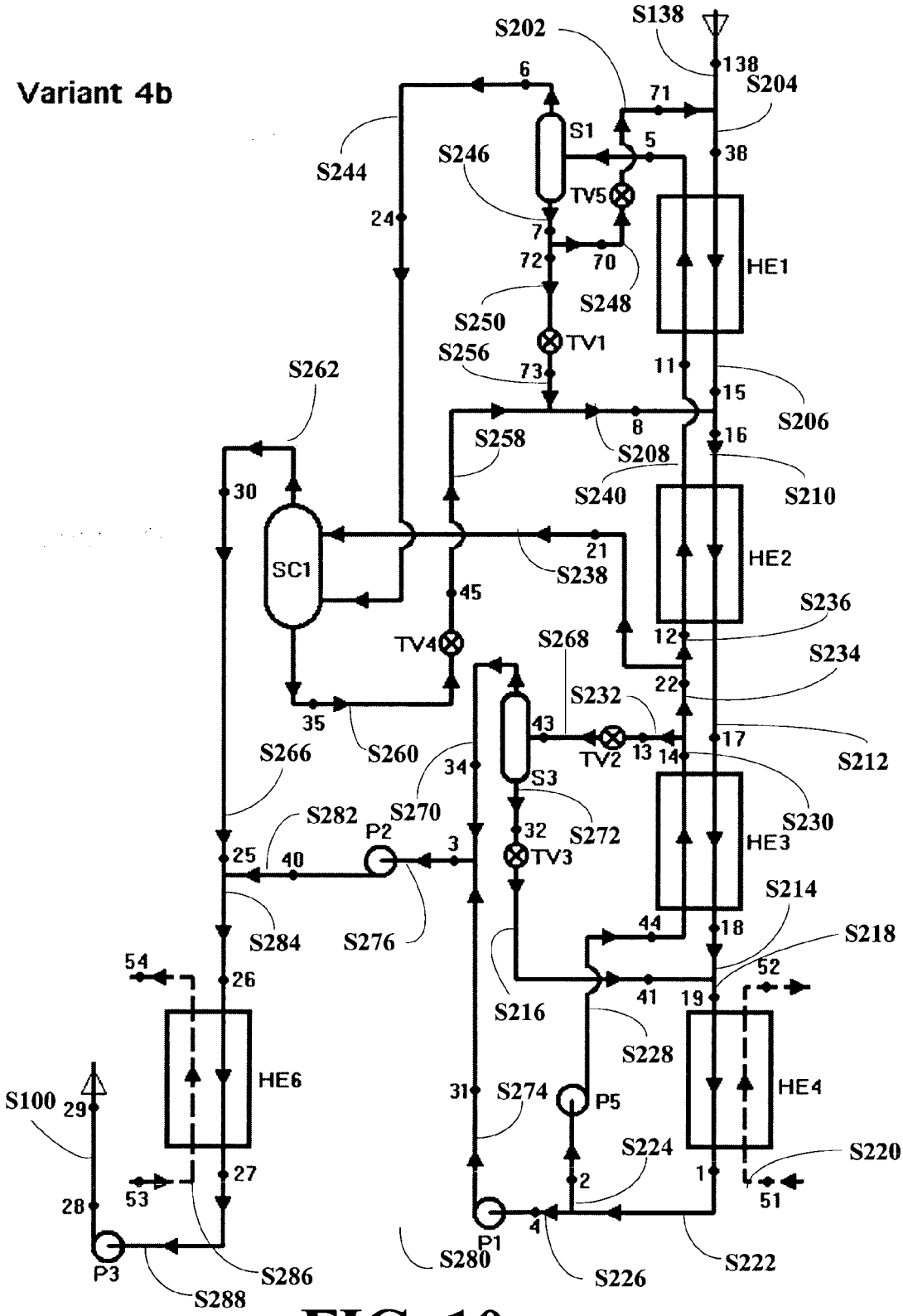
FIG. 10 depicts a block diagram of a preferred embodiment of CTCSS Variant 4*b* of a condensation and thermal compression subsystems.
Figure 11:
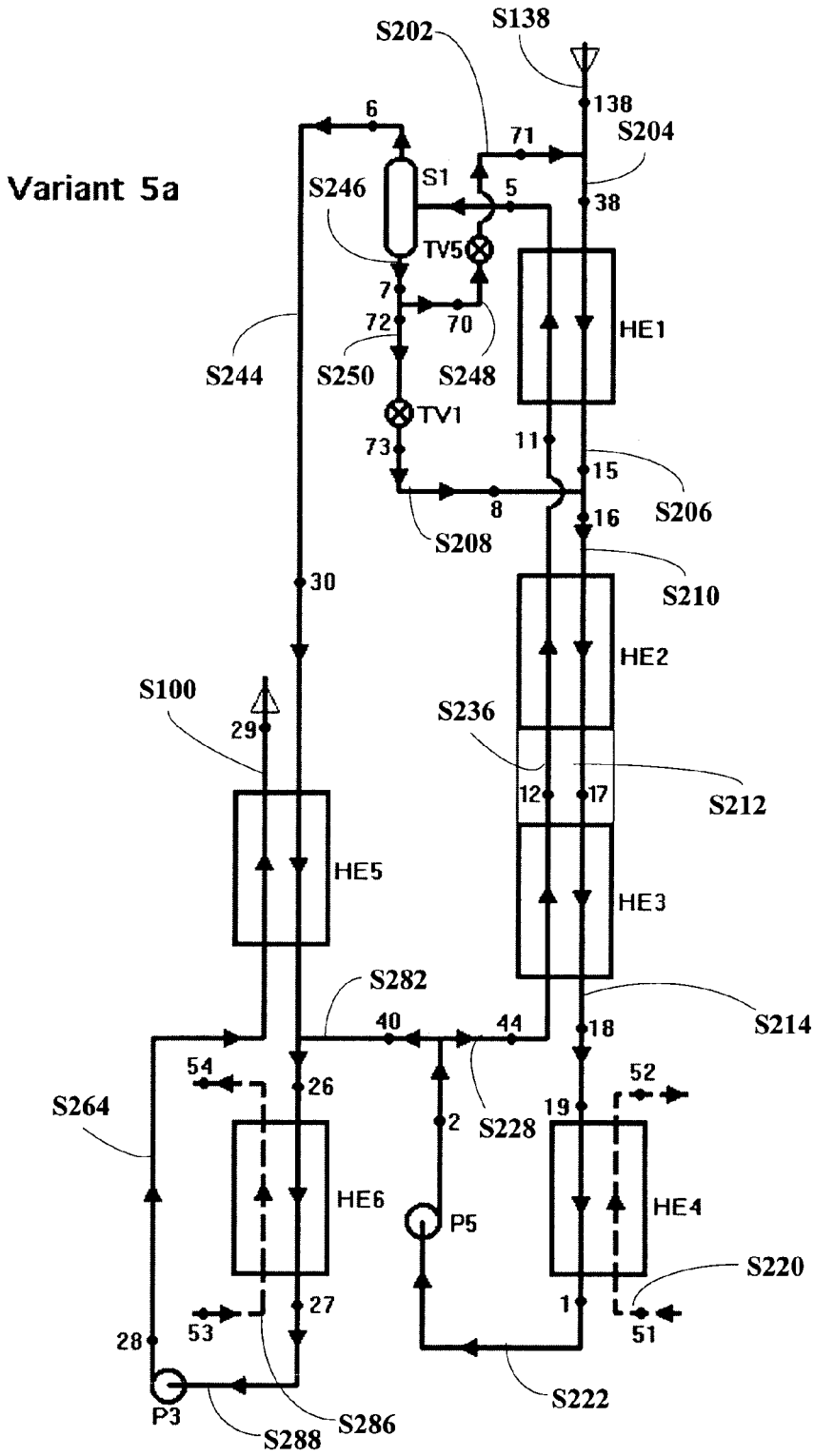
FIG. 11 depicts a block diagram of a preferred embodiment of CTCSS Variant 5*a* of a condensation and thermal compression subsystems.
Figure 12:
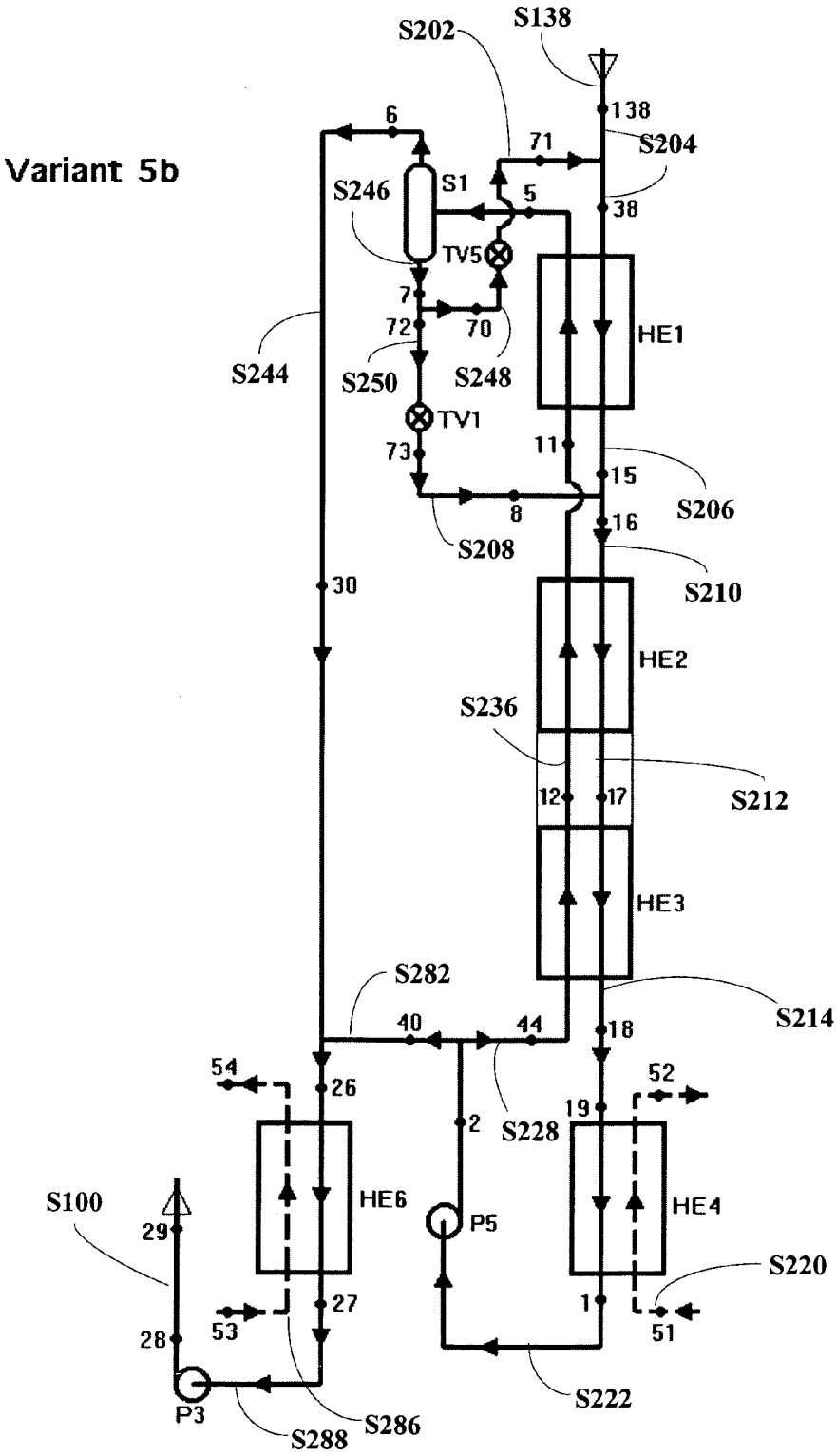
FIG. 12 depicts a block diagram of a preferred embodiment of CTCSS Variant 5*b* of a condensation and thermal compression subsystems.

A final modular simplification is attained by eliminating the scrubber SC1, and the use of the stream S282 having the parameters as at the point 40 without any enrichment, i.e., the composition of stream S282 having the parameters as at the point 40 is the same as the composition of the basic solution. This modular simplification of Variant 4*a*, with preheating of the stream S264 of the working fluid having the parameters as at the point 28 is shown in FIG. 9, and is referred to as Variant 5*a*. A similar simplification of Variant 4*b*, without preheating the stream S264 of the working fluid having the parameters as at the point 28, is shown in FIG. 10, and referred to as Variant 5*b*. It must be noted that the modular simplification of the Variant 5*a* and Variant 5*b* results in a substantial reduction of the efficiency of the CTCSS. Also in Variants 5*a* and 5*b*, the stream S222 having the parameters as at the point 1 is not split into two substreams S222 and S224 which are then separately pressurized, but is pressurized in as a single stream in a pump P5 forming a stream S292 having parameters as at a point 46. The stream S292 is then split to form the stream S228 having the parameters as at the point 44 and the stream S282 having the parameters as at the point 40.

The CTCSSs of this invention is described in the five basic variants given above; (two of which utilize external heat, and three of which utilize only the heat available from the stream S200 of the working fluid entering the CTCSSs of this invention). One experienced in the art would be able to generate additional combinations and variants of the proposed systems. For instance, it is possible to simplify Variant 4*a* by eliminating the scrubber SC1, while retaining the enrichment of the stream S282 having the parameters as at the points 40. (Likewise it is possible to retain the scrubber SC1, and eliminate only the enrichment process for the stream S282 having the parameters as at the points 40.) However all such modular simplifications are still based on the initial Variant 1*a* of the CTCSSs of this invention.

The efficacy of the CTCSS of this invention, per se, can be assessed by its compression ratio; i.e., a ratio of the pressure of the stream S284 having the parameters as at the point 26 (at the entrance to the high pressure condenser, heat exchanger HE6) to the pressure of the stream S138 having the parameters as at the point 138 (at the point of entrance of the stream of working solution into the CTCSS). The impact of the efficacy of the CTCSS on the efficiency of the whole system depends on the structure and parameters of work of the whole system. For assessing the CTCSSs of this invention, several calculations have been performed. A stream comprising a water-ammonia mixture having a composition of 0.83 weight fraction of ammonia (i.e., 83 wt. % ammonia), with an initial temperature of 1050° F. and an initial pressure of 1800 psia, has been expanded in a turbine with an isoenthropic efficiency of 0.875 (87.5%). The parameters of the vapor upon exiting the turbine correspond to the stream S138 having the parameters at the point 138. Such computations have been performed for all proposed "b" variants of the CTCSS of this invention described above, and for a simple condenser system as well. These calculations are presented in Table 2. It should be noted that the incremental enthalpy drop produced by using a CTCSS of this invention is specific to the exact parameters of pressure and temperature at the turbine inlet. If these parameters were to be lowered, then the percentage of increase in enthalpy drop would be substantially larger.

TABLE 2

Efficacy of CTCSS Variants 1b, 2b, 3b, 4b, and 5b

| | Simple Condenser | CTCSS Variant 1b | CTCSS Variant 2b | CTCSS Variant 3b | CTCSS Variant 4b | CTCSS Variant 5b |
|---|---|---|---|---|---|---|
| pressure of turbine outlet (point 138) (psia) | 100.823 | 35.771 | 38.972 | 42.067 | 45.079 | 59.368 |
| compression ratio (P26:P138) | 1.000 | 2.8181 | 2.5871 | 2.3967 | 2.2366 | 1.69827 |
| turbine enthalpy drop (btu/lb) | 337.3891 | 418.6930 | 412.5639 | 407.0011 | 410.8869 | 380.7543 |
| incremental enthalpy drop (btu/lb) | 0.000 | 81.3040 | 75.1748 | 69.6119 | 64.4978 | 43.3652 |
| incremental enthalpy drop (%) | 0.000 | 24.098 | 22.281 | 20.633 | 19.117 | 12.853 |

Comparison has shown that all variants of the CTCSSs of this invention have an efficacy that is higher or equal to comparable subsystems in the prior art. However, all of the proposed CTCSS are substantially simpler and less expensive than the subsystems described in the prior art.

The proposed system has all the advantages of systems given in the prior art, but is much simpler and does not require an expensive separate intercooler. Moreover, the loss of pressure in the process of intercooling is smaller because there is no entrance and exit pressure losses into or out of a special separate intercooler heat exchanger.

Due to the fact that the working fluid in the intercooler portion of the HRVG transfers its heat to the flue gas, as opposed to directly transferring the heat to the upcoming stream of working fluid, the temperature difference in between the working fluid flowing through the intercooler and the upcoming stream of high pressure working fluid is larger than the analagous temperature differnce in the prior art. As a result the proposed system has a slightly lower thermal efficiency that the system described in the prior art. Detailed calculations have shown that the proposed system has an efficiency which is 0.85% lower than the system described in the prior art.

However, the proposed system allows for the cooling of flue gas to a lower temperature than is possible in the system described in the prior art, and therefore the proposed system is able to utilize more heat for a given heat source stream. As a result, the total output of the proposed system when used as a bottoming cycle in a combined cycle is 1.6% higher than the total output of the system described in the prior art used in the same manner. Thus the overall efficiency of a combined cycle system is increased by 0.64% as compared to the overall combined cycle efficiency using the system described in the prior art.

The proposed system uses a CTCSS (compression thermal condensation subsystem) which is substantially simpler and therefore less expensive than the DCSS (distilation condensation subsystem) used in the prior art.

This, together with the elimination of the requirement of a separate apparatus for intercooling, makes the proposed system significantly less expensive and at the same time slightly increasing the overall efficiency of a combined cycle using the proposed system as compared to the system described in the prior art.

The proposed system can be simplified by the exclusion of process of reheating. Such a system is presented in FIG. 2. It does not require a separate description. The efficiency of such a simplified system is lower than the efficiency of the system shown in FIG. 1, but it is still higher than the efficiency of a double pressure or triple pressure Rankine cycle that is commonly used as the bottoming cycle for combined cycle power systems.

A summary of performance, and parameters at all key points for the proposed system are presented in Tables 3 and 4 (below.)

TABLE 3

System Performance Summary

| | | | | |
|---|---|---|---|---|
| Heat in | 412,140.52 | kW | 1,228.46 | Btu/lb |
| Heat rejected | 248,089.38 | kW | 739.47 | Btu/lb |
| Turbine enthalpy Drops | 169,917.96 | kW | 506.47 | Btu/lb |
| Gross Generator Power | 166,995.38 | kW | 497.76 | Btu/lb |
| Process Pumps (−17.49) | −6,233.33 | kW | −18.58 | Btu/lb |
| Cycle Output | 160,762.04 | kW | 479.18 | Btu/lb |
| Other Pumps and Fans (−5.27) | −1,878.22 | Kw | −5.60 | Btu/lb |
| Net Output | 158,883.82 | kW | 473.58 | Btu/lb |
| Gross Generator Power | 166,995.38 | kW | 497.76 | Btu/lb |
| Cycle Output | 160,762.04 | Kw | 479.18 | Btu/lb |
| Net Output | 158,883.82 | kW | 473.58 | Btu/lb |
| Net thermal efficiency | 38.55% | % | | |
| Second Law Limit | 48.78% | % | | |
| Second Law Efficiency | 79.03% | % | | |

Overall Heat Balance (Btu/lb)

Heat In: Source + pumps = 1,228.46 + 17.49 = 1,245.95

Heat Out: Turbines + condenser = 506.47 + 739.47 = 1,245.95

TABLE 4

System Point Summary

| Pt. | X lb/lb | T ° F. | P psia | H Btu/lb | S Btu/lb-R | Ex Btu/lb | G rel G/G = 1 | G abs lb/h | Ph. lb/lb | Wetness |
|---|---|---|---|---|---|---|---|---|---|---|
| | | | | | Working Fluid | | | | | |
| 1 | 0.5132 | 60.79 | 36.056 | −77.7760 | 0.0029 | 0.4290 | 6.78958 | 7,777,604 | Mix | 1 |
| 2 | 0.5132 | 60.79 | 36.056 | −77.7760 | 0.0029 | 0.4290 | 6.40563 | 7,337,775 | Mix | 1 |
| 3 | 0.6603 | 86.48 | 64.861 | 123.4582 | 0.3613 | 16.4296 | 0.55211 | 632,455 | Mix | 0.725 |
| 4 | 0.5132 | 60.79 | 36.056 | −77.7760 | 0.0029 | 0.4290 | 0.38396 | 439,828 | Mix | 1 |
| 5 | 0.5132 | 180.60 | 89.976 | 261.0451 | 0.5755 | 42.2910 | 1.28756 | 1,474,928 | Mix | 0.6698 |
| 6 | 0.9425 | 180.60 | 89.976 | 653.4035 | 1.2520 | 85.7031 | 0.42514 | 487,001 | Mix | 0 |
| 7 | 0.3015 | 180.60 | 89.976 | 67.6314 | 0.2420 | 20.8909 | 0.86243 | 987,928 | Mix | 1 |
| 8 | 0.3055 | 141.58 | 38.306 | 65.4145 | 0.2423 | 18.5469 | 1.03795 | 1,188,995 | Mix | 0.9433 |
| 11 | 0.5132 | 136.58 | 92.976 | 96.2128 | 0.3076 | 16.3960 | 1.28756 | 1,474,928 | Mix | 0.8509 |
| 12 | 0.5132 | 114.11 | 95.976 | −18.1700 | 0.1116 | 3.7026 | 1.28756 | 1,474,928 | Mix | 1 |
| 13 | 0.5132 | 114.11 | 95.976 | −18.1700 | 0.1116 | 3.7026 | 4.91979 | 5,635,716 | Mix | 1 |
| 14 | 0.5132 | 114.11 | 95.976 | −18.1700 | 0.1116 | 3.7026 | 6.40563 | 7,337,775 | Mix | 1 |
| 15 | 0.8100 | 141.58 | 38.306 | 515.8753 | 1.0937 | 29.6738 | 1.00000 | 1,145,520 | Mix | 0.1999 |
| 16 | 0.5530 | 141.58 | 38.306 | 286.4505 | 0.6601 | 24.0067 | 2.03795 | 2,334,514 | Mix | 0.5786 |
| 17 | 0.5530 | 119.73 | 37.556 | 214.1843 | 0.5385 | 14.7790 | 2.03795 | 2,334,514 | Mix | 0.6476 |
| 18 | 0.5530 | 71.24 | 36.806 | 27.9646 | 0.2025 | 2.8471 | 2.03795 | 2,334,514 | Mix | 0.8523 |
| 19 | 0.5132 | 71.58 | 36.806 | −19.1982 | 0.1143 | 1.2574 | 6.78958 | 7,777,604 | Mix | 0.9265 |
| 21 | 0.5132 | 110.55 | 89.226 | −18.1700 | 0.1116 | 3.6656 | 0.19828 | 227,131 | Mix | 0.9932 |
| 22 | 0.5132 | 114.11 | 95.976 | −18.1700 | 0.1116 | 3.7026 | 1.48584 | 1,702,059 | Mix | 1 |
| 23 | 0.6603 | 60.79 | 64.111 | −62.6517 | 0.0113 | 11.8994 | 0.55211 | 632,455 | Mix | 1 |
| 24 | 0.9425 | 180.60 | 89.976 | 653.4035 | 1.2520 | 85.7031 | 0.42514 | 487,001 | Mix | 0 |
| 25 | 0.9945 | 67.70 | 88.476 | 547.2777 | 1.0771 | 70.5188 | 0.44789 | 513,065 | Mix | 0.02 |
| 26 | 0.8100 | 76.25 | 88.476 | 210.6374 | 0.4891 | 38.0153 | 1.00000 | 1,145,520 | Mix | 0.5832 |
| 27 | 0.8100 | 60.79 | 87.726 | −28.3647 | 0.0351 | 34.4690 | 1.00000 | 1,145,520 | Mix | 1 |
| 28 | 0.8100 | 62.70 | 801.242 | −24.7263 | 0.0363 | 37.4862 | 1.00000 | 1,145,520 | Liq | −162.95° F. |
| 29 | 0.8100 | 79.91 | 796.242 | −5.2335 | 0.0731 | 37.9159 | 1.00000 | 1,145,520 | Liq | −145.1° F. |
| 30 | 0.9945 | 115.55 | 89.226 | 590.7993 | 1.1552 | 73.5436 | 0.44789 | 513,065 | Mix | 0 |
| 31 | 0.5132 | 60.91 | 64.861 | −77.5683 | 0.0031 | 0.5328 | 0.38396 | 439,828 | Liq | −30.32° F. |
| 32 | 0.4961 | 95.69 | 64.861 | −39.4261 | 0.0749 | 1.3864 | 4.75163 | 5,443,089 | Mix | 1 |
| 34 | 0.9962 | 95.69 | 64.861 | 582.4652 | 1.1758 | 54.4994 | 0.16816 | 192,627 | Mix | 0 |
| 35 | 0.3248 | 171.60 | 89.976 | 54.5222 | 0.2246 | 16.9105 | 0.17552 | 201,067 | Mix | 1 |

TABLE 4-continued

System Point Summary

| Pt. | X lb/lb | T ° F. | P psia | H Btu/lb | S Btu/lb-R | Ex Btu/lb | G rel G/G = 1 | G abs lb/h | Ph. lb/lb | Wetness |
|---|---|---|---|---|---|---|---|---|---|---|
| 38 | 0.8100 | 185.60 | 39.056 | 728.1070 | 1.4307 | 67.1204 | 1.00000 | 1,145,520 | Mix | 0 |
| 40 | 0.6603 | 60.92 | 88.476 | −62.4543 | 0.0115 | 11.9938 | 0.55211 | 632,455 | Liq | −17.52° F. |
| 41 | 0.4961 | 71.71 | 36.806 | −39.4261 | 0.0765 | 0.5759 | 4.75163 | 5,443,089 | Mix | 0.9584 |
| 43 | 0.5132 | 95.69 | 64.861 | −18.1700 | 0.1125 | 3.2018 | 4.91979 | 5,635,716 | Mix | 0.9658 |
| 44 | 0.5132 | 60.97 | 100.976 | −77.4158 | 0.0032 | 0.6625 | 6.40563 | 7,337,775 | Liq | −56.28° F. |
| 45 | 0.3248 | 134.31 | 38.306 | 54.5222 | 0.2278 | 15.2508 | 0.17552 | 201,067 | Mix | 0.9428 |
| 70 | 0.3015 | 180.60 | 89.976 | 67.6314 | 0.2420 | 20.8909 | 0.00000 | 0 | Mix | 1 |
| 71 | 0.3015 | 143.85 | 39.056 | 67.6313 | 0.2450 | 19.3202 | 0.00000 | 0 | Mix | 0.9446 |
| 72 | 0.3015 | 180.60 | 89.976 | 67.6314 | 0.2420 | 20.8909 | 0.86243 | 987,928 | Mix | 1 |
| 73 | 0.3015 | 143.06 | 38.306 | 67.6313 | 0.2452 | 19.2540 | 0.86243 | 987,928 | Mix | 0.9435 |
| 100 | 0.8100 | 85.97 | 3,028.000 | 6.1197 | 0.0765 | 47.5287 | 1.00000 | 1,145,520 | Liq | −466.2° F. |
| 101 | 0.8100 | 268.57 | 2,998.000 | 224.5656 | 0.4207 | 87.3995 | 1.00000 | 1,145,520 | Liq | −281.92° F. |
| 102 | 0.8100 | 504.48 | 2,958.000 | 720.6200 | 1.0040 | 280.9530 | 1.00000 | 1,145,520 | Vap | 261.5° F. |
| 103 | 0.8100 | 836.22 | 2,908.000 | 1,048.5341 | 1.3021 | 454.2381 | 1.00000 | 1,145,520 | Vap | 593.3° F. |
| 104 | 0.8100 | 1,076.89 | 2,873.000 | 1,243.4311 | 1.4414 | 576.8966 | 1.00000 | 1,145,520 | Vap | 834° F. |
| 105 | 0.8100 | 1,050.00 | 950.116 | 1,251.24 | 1.5709 | 517.5241 | 1.00000 | 1,145,520 | Vap | 671.5° F. |
| 106 | 0.8100 | 836.22 | 985.116 | 1,093.7246 | 1.4544 | 420.4401 | 1.00000 | 1,145,520 | Vap | 455.1° F. |
| 107 | 0.8100 | 593.19 | 105.910 | 956.7157 | 1.5898 | 213.1765 | 1.00000 | 1,145,520 | Vap | 357° F. |
| 108 | 0.8100 | 308.74 | 90.910 | 790.3462 | 1.4235 | 133.1037 | 1.00000 | 1,145,520 | Vap | 80.8° F. |
| 109 | 0.8100 | 1,076.00 | 2,823.000 | 1,243.4311 | 1.4433 | 575.8861 | 1.00000 | 1,145,520 | Vap | 833.1° F. |
| 110 | 0.8100 | 371.74 | 94.232 | 825.9539 | 1.4639 | 147.7179 | 1.00000 | 1,145,520 | Vap | 141.9° F. |
| 111 | 0.8100 | 341.74 | 2,985.594 | 332.3002 | 0.5615 | 122.1159 | 1.00000 | 1,145,520 | Liq | −208.05° F. |
| 117 | 0.8100 | 0.00 | 14.693 | 0.0000 | 0.0000 | 0.0000 | 0.00000 | 0 | Mix | 0 |
| 129 | 0.8100 | 79.91 | 796.242 | −5.2335 | 0.0731 | 37.9159 | 1.00000 | 1,145,520 | Liq | −145.1° F. |
| 138 | 0.8100 | 185.60 | 39.056 | 728.1070 | 1.4307 | 67.1204 | 1.00000 | 1,145,520 | Mix | 0 |
| Heat Source | | | | | | | | | | |
| 600 | GAS | 1,134.10 | 15.416 | 351.4434 | 0.4542 | 136.5076 | 4.46873 | 5,119,020 | Vap | 1022.5° F. |
| 601 | GAS | 1,134.10 | 15.416 | 351.4434 | 0.4542 | 136.5076 | 2.47137 | 2,831,001 | Vap | 1022.5° F. |
| 602 | GAS | 1,134.10 | 15.416 | 351.4434 | 0.4542 | 136.5076 | 1.99736 | 2,288,019 | Vap | 1022.5° F. |
| 603 | GAS | 851.23 | 15.208 | 272.5814 | 0.4007 | 85.3904 | 2.47137 | 2,831,001 | Vap | 740.1° F. |
| 605 | GAS | 851.23 | 15.208 | 272.5814 | 0.4007 | 85.3904 | 4.46873 | 5,119,020 | Vap | 740.1° F. |
| 606 | GAS | 851.23 | 15.208 | 272.5814 | 0.4007 | 85.3904 | 1.99736 | 2,288,019 | Vap | 740.1° F. |
| 607 | GAS | 578.19 | 15.024 | 199.2017 | 0.3389 | 44.0996 | 4.46873 | 5,119,020 | Vap | 467.5° F. |
| 608 | GAS | 293.74 | 14.822 | 125.4257 | 0.2568 | 12.8823 | 4.46873 | 5,119,020 | Vap | 183.5° F. |
| 609 | GAS | 108.72 | 14.693 | 76.5425 | 0.1827 | 2.4190 | 4.46873 | 5,119,020 | Mix | 0.0019 |
| 610 | GAS | 356.74 | 14.868 | 141.5658 | 0.2772 | 18.4650 | 4.46873 | 5,119,020 | Vap | 246.4° F. |
| 611 | GAS | 578.19 | 15.024 | 199.2017 | 0.3389 | 44.0996 | 6.72379 | 7,702,240 | Vap | 467.5° F. |
| 612 | GAS | 293.74 | 14.822 | 125.4257 | 0.2568 | 12.8823 | 6.72379 | 7,702,240 | Vap | 183.5° F. |
| 621 | GAS | 578.19 | 15.024 | 199.2017 | 0.3389 | 44.0996 | 2.25506 | 2,583,220 | Vap | 467.5° F. |
| 622 | GAS | 293.74 | 14.822 | 125.4257 | 0.2568 | 12.8823 | 2.25506 | 2,583,220 | Vap | 183.5° F. |
| Coolant | | | | | | | | | | |
| 50 | Water | 51.70 | 14.693 | 19.8239 | 0.0394 | 0.0948 | 26.9165 | 30,833,419 | Liq | −160.25° F. |
| 51 | Water | 51.79 | 24.693 | 19.9424 | 0.0396 | 0.1233 | 26.9165 | 30,833,419 | Liq | −187.57° F. |
| 52 | Water | 66.58 | 14.693 | 34.7184 | 0.0682 | 0.0977 | 26.9165 | 30,833,419 | Liq | −145.38° F. |
| 53 | Water | 51.70 | 14.693 | 19.8239 | 0.0394 | 0.0948 | 13.8526 | 15,868,401 | Liq | −160.25° F. |
| 54 | Water | 51.79 | 24.693 | 19.9424 | 0.0396 | 0.1233 | 13.8526 | 15,868,401 | Liq | −187.57° F. |
| 55 | Water | 69.06 | 14.693 | 37.1957 | 0.0729 | 0.1391 | 13.8526 | 15,868,401 | Liq | −142.9° F. |
| 56 | Water | 51.70 | 14.693 | 19.8239 | 0.0394 | 0.0948 | 3.70679 | 4,246,203 | Liq | −160.25° F. |
| 57 | Water | 51.79 | 24.693 | 19.9424 | 0.0396 | 0.1233 | 3.70679 | 4,246,203 | Liq | −187.57° F. |
| 58 | Water | 79.53 | 14.693 | 47.6627 | 0.0925 | 0.4385 | 3.70679 | 4,246,203 | Liq | −132.43° F. |

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

I claim:

1. A bottoming cycle system comprising:

a heat recovery vapor generator subsystem HRVG including:

a preheater section for preheating a fully condensed, high pressure working fluid stream with heat derived from a cool heat source stream to form a preheated, high pressure working fluid stream and a spent heat source stream;

an intercooler section for vaporizing the preheated, high pressure working fluid stream with heat derived from a cooled heat source stream and a low pressure working fluid stream to form a vaporized high pressure working fluid stream, a cooled low pressure working fluid stream and the cool heat source stream; and a superheater section for superheating the vaporized, high pressure working fluid stream with heat derived from a hot heat source stream to form a superheated, high pressure working fluid stream and the cooled heat source stream;

where the fully condensed, high pressure working fluid stream is preheated, vaporized and superheated to form the superheated, high pressure working fluid stream within the HRVG;

a multi-stage energy conversion or turbine subsystem T including:

a high pressure turbine or turbine stage HPT for converting a portion of thermal energy in the superheated working fluid stream into a first portion of mechanical and/or electrical power to form the low pressure, working fluid stream; and a low pressure turbine or turbine stage LPT for converting a portion of thermal energy in the cooled low pressure working fluid stream into a second portion of mechanical and/or electrical power to form a spent working fluid stream; and a condensation thermal compression subsystem CTCSS for condensing the spent working fluid stream to from the fully condensed, high pressure working fluid stream.

2. The apparatus of claim 1, wherein the HRVG further includes:

a reheater or top section for reheating an intermediate pressure, working fluid stream from the HPT with heat derived from the hot heat source stream to from a heated, intermediate pressure stream, and wherein the turbine subsystem T further includes:

an intermediate pressure turbine or turbine stage IPT interposed between the HPT and the LPT for converting a portion of thermal energy in the heated intermediate pressure, working fluid stream into a third portion of mechanical and/or electrical power to form the low pressure, working fluid stream.

3. The system of claim 1, wherein the CTCSS comprises a simple condenser.

4. The system of claim 1, wherein the CTCSS comprises a plurality of heat exchangers, at least one separators, a plurality of pumps, a plurality of throttle valves, a plurality of mixing valves and a plurality of combining valves arranged to efficiently convert the spent working fluid stream into the fully condensed working fluid stream by forming streams of different compositions, pressure and temperature and using an external cooling stream to fully condense the spent working fluid stream into the fully condensed working fluid stream.

5. The system of claim 1, wherein the preheater comprises section HR1 of the HRVG.

6. The system of claim 1, wherein the intercooler comprises sections HR2 and HR3 of the HRVG.

7. The system of claim 1, wherein the superheater comprises sections HR4 and HR5 of the HRVG.

8. The system of claim 2, wherein the reheater comprises section HR5 of the HRVG.

9. The system of claim 1, wherein the working fluid is a multi-component fluid.

10. The system of claim 1, wherein the multi-component fluid is selected from the group consisting of an ammonia-water mixture, a mixture of two or more hydrocarbons, a mixture of two or more freons, and a mixture of hydrocarbons and freons.

11. The system of claim 1, wherein the composition of the incoming multi-component stream comprises a mixture of water and ammonia.

12. A method comprising the steps of:

bringing a fully condensed, high pressure working fluid stream into a first heat exchange relationship with a cool heat source stream in a preheater of a heat recovery vapor generator subsystem HRVG to form a spent heat source stream and a preheated, high pressure working fluid stream;

bringing the preheated, high pressures working fluid stream into a second heat exchange relationship with a cooled heat source stream and a low pressure working fluid stream in an intercooler of the HRVG to form a vaporized, high pressure working fluid stream, the cool heat source stream, and a cooled low pressure working fluid stream;

bringing the vaporized, high pressure working fluid stream into a third heat exchange relationship with a hot heat source stream in a superheater of the HRVG to form a superheated, high pressure working fluid stream and the cooled heat source stream;

converting a portion of thermal energy in the superheated, high pressure working fluid stream into a first portion of mechanical and/or electrical power in a high pressure turbine or turbine stage HPT of a turbine subsystem T to form the low pressure working fluid stream;

converting a portion of thermal energy in the cooled low pressure working fluid stream into a second portion of mechanical and/or electrical power in a low pressure turbine or turbine stage LPT of a turbine subsystem T to form a spent working fluid stream; and condensing the spent working fluid stream in a condensation thermal compression subsystem CTCSS to form the fully condensed, high pressure working fluid stream, where the fully condensed, high pressure working fluid stream is preheated, vaporized and superheated to form the superheated, high pressure working fluid stream within the HRVG.

13. The method of claim 12, further comprising the steps of:

prior to the second converting step, reheating an intermediate pressure working fluid stream from the HPT in a reheater or top section of the HRVG to form a heated, intermediate pressure working fluid stream; and converting a portion of thermal energy in the heated intermediate pressure working fluid stream into a third portion of mechanical and/or electrical power in an intermediate pressure turbine or turbine stage IPT of a turbine subsystem T to form the low pressure working fluid stream.

14. The method of claim 12, wherein the preheater comprises section HR1 of the HRVG.

15. The method of claim 12, wherein the intercooler comprises sections HR2 and HR3 sections of the HRVG.

16. The method of claim 12, wherein the superheater comprises section HR4 and HR5 sections of the HRVG.

17. The method of claim 12, wherein the working fluid is a multi-component fluid.

18. The method of claim 12, wherein the multi-component fluid is selected from the group consisting of an ammonia-water mixture, a mixture of two or more hydrocarbons, a mixture of two or more freons, and a mixture of hydrocarbons and freons.

19. The method of claim 12, wherein the composition of the incoming multi-component stream comprises a mixture of water and ammonia.

20. The method of claim 12, wherein the CTCSS comprises a simple condenser.

21. The method of claim 12, wherein the CTCSS comprises a plurality of heat exchangers, at least one separators, a plurality of pumps, a plurality of throttle valves, a plurality of mixing valves and a plurality of combining valves arranged to efficiently convert the spent working fluid stream into the fully condensed working fluid stream by forming streams of different compositions, pressure and temperature and using an external cooling stream to fully condense the spent working fluid stream into the fully condensed working fluid stream.

22. The system of claim 1, wherein the CTCSS comprises:

a separation subsystem comprising a separator adapted to produce a rich vapor stream and a lean liquid stream;

a heat exchange subsystem comprising three heat exchangers and two throttle control valves adapted to mix a pressure adjusted first portion of the lean liquid stream with an incoming stream to form a pre-basic solution stream, to mix a pressure adjusted second portion of the lean liquid stream with the pre-basic solution stream to form a basic solution stream, to bring a first portion of a pressurized fully condensed basic solution stream into a heat exchange relationship with the pre-basic solution stream to form a partially condensed basic solution stream;

a first condensing and pressurizing subsystem comprising a first condenser and a first pump adapted to fully condense the partially condensed basic solution stream to form a fully condensed basic solution stream and to pressurize the fully condensed basic solution stream to form a pressurized fully condensed working fluid stream; and a second condensing and pressurizing subsystem comprising a second condenser and a second pump adapted to mix a second portion of the fully condensed basic solution stream and the rich vapor stream to form an outgoing stream, to fully condense the outgoing stream and to pressurize the outgoing stream to a desired high pressure, where the first portion of the lean liquid stream is pressure adjusted to have the same or substantially the same pressure as the incoming stream and where the second portion of the lean stream is pressure adjusted to have the same or substantially the same pressure as the pre-basic solution stream and where the streams comprise at least one lower boiling component and at least one higher boiling component and the compositions of the streams are the same or different with the composition of the incoming stream and the outgoing stream being the same.

23. The method of claim 12, wherein the CTCSS comprises:

a separation subsystem comprising a separator adapted to produce a rich vapor stream and a lean liquid stream;

a heat exchange subsystem comprising three heat exchangers and two throttle control valves adapted to mix a pressure adjusted first portion of the lean liquid stream with an incoming stream to form a pre-basic solution stream, to mix a pressure adjusted second portion of the lean liquid stream with the pre-basic solution stream to form a basic solution stream, to bring a first portion of a pressurized fully condensed basic solution stream into a heat exchange relationship with the pre-basic solution stream to form a partially condensed basic solution stream;

a first condensing and pressurizing subsystem comprising a first condenser and a first pump adapted to fully condense the partially condensed basic solution stream to form a fully condensed basic solution stream and to pressurize the fully condensed basic solution stream to form a pressurized fully condensed working fluid stream; and a second condensing and pressurizing subsystem comprising a second condenser and a second pump adapted to mix a second portion of the fully condensed basic solution stream and the rich vapor stream to form an outgoing stream, to fully condense the outgoing stream and to pressurize the outgoing stream to a desired high pressure, where the first portion of the lean liquid stream is pressure adjusted to have the same or substantially the same pressure as the incoming stream and where the second portion of the lean stream is pressure adjusted to have the same or substantially the same pressure as the pre-basic solution stream and where the streams comprise at least one lower boiling component and at least one higher boiling component and the compositions of the streams are the same or different with the composition of the incoming stream and the outgoing stream being the same.

* * * * *